US006621228B2

(12) United States Patent
Harada et al.

(10) Patent No.: US 6,621,228 B2
(45) Date of Patent: Sep. 16, 2003

(54) EL DISPLAY APPARATUS

(75) Inventors: Shigeyuki Harada, Neyagawa (JP); Atsushi Kiyohara, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 87 days.

(21) Appl. No.: 09/845,684

(22) Filed: May 1, 2001

(65) Prior Publication Data

US 2002/0033676 A1 Mar. 21, 2002

(30) Foreign Application Priority Data

May 1, 2000 (JP) ..... 2000-132756
May 2, 2000 (JP) ..... 2000-133718
Mar. 23, 2001 (JP) ..... 2001-086062

(51) Int. Cl.[7] ..... G09G 3/12
(52) U.S. Cl. ..... 315/169.3; 345/79; 345/209
(58) Field of Search ..... 315/169.3, 169.4, 315/169.1; 345/79, 209, 211

(56) References Cited

U.S. PATENT DOCUMENTS 4,962,374 A 10/1990 Fujioka et al.
4,999,618 A * 3/1991 Inada et al. ..... 315/169.3

FOREIGN PATENT DOCUMENTS

JP 6-34152 B2 5/1994
JP 2619001 B2 3/1997

* cited by examiner

*Primary Examiner*—David Vu
(74) *Attorney, Agent, or Firm*—Nixon & Vanderhye P.C.

(57) ABSTRACT

A data side driving IC incorporates pull-up elements and pull-down elements to be applied with modulating voltages of +½VM and −½VM, respectively. A scanning side driving IC incorporates pull-up elements to be applied with a positive write voltage of +VW from a positive voltage supply circuit, and pull-down elements to be applied with a negative write voltage of −VW from a negative voltage supply circuit. Each data electrode is driven by a positive voltage of +½VM or a negative voltage of −½VM. Each scanning electrode is controlled so that it is applied with a positive write voltage of +VW or a negative write voltage of −VW or it assumes a ground potential or a floating potential. Since the data electrodes and the scanning electrodes can be driven with high symmetry of positive and negative polarities, the long-term reliability can be enhanced, while at the same time the peripheral circuitry can be simplified.

19 Claims, 19 Drawing Sheets

EL DISPLAY APPARATUS

BACKGROUND OF THE INVENTION

1. Field of the Invention

The present invention relates to EL display apparatus for displaying images or the like using an electroluminescent (hereinafter abbreviated as "EL") layer.

2. Description of the Related Art

Attention has been paid for years to EL display apparatus of a basic configuration as shown in FIG. 15 as a self-luminescent type flat display apparatus. The basic configuration of an EL display apparatus includes an electrically insulating transparent substrate 1 such as made of glass, strip-shaped transparent electrodes 2 arranged as extending parallel with each other on the glass substrate 1, a dielectric material layer 3 covering the transparent electrodes 2, and an EL layer of an inorganic material formed on the dielectric material layer 3. On this structure are further stacked a dielectric material layer 5 and strip-shaped back face electrodes 6 arranged as extending parallel with each other on the dielectric material layer 5. The transparent electrodes 2 and the back face electrodes 6 are each formed as a group of parallel fine wires and extend perpendicularly to each other.

FIG. 16 shows an applied voltage-luminance characteristic of the EL layer 4 shown in FIG. 15. The EL layer 4 is formed by doping zinc sulfide (ZnS) as an inorganic fluorescent substance with an activator such as manganese (Mn). When the applied voltage reaches about 180 V, luminescence begins to occur and its luminance grows higher with rising voltage. When a voltage higher than a given voltage, for example about 230 V, is applied, the EL layer 4 gives off light at a sufficient luminance. Thus, the EL layer 4 needs to be driven by application of a relatively high voltage of about 200 V for its luminescence to occur.

EL display apparatus of the type shown in FIG. 15 are adapted to display an image on the glass substrate 1 side. In this case, the transparent electrodes 2 on the glass substrate 1 side serve as data side electrodes, while the back face electrodes 6 serves as scanning side electrodes. The points of intersection of the transparent electrodes 2 on the data side and the back face electrodes 6 on the scanning side each form a pixel. Thus, a display panel has a plurality of such pixels arranged in a matrix pattern.

FIG. 17 shows a change in characteristics with time in the case where each electrode is driven by application of a symmetric waveform and that in the case where each electrode is driven by application of an a symmetric waveform for comparison. As seen from the characteristic resulting from the application of the asymmetric waveform plotted by one-dot chain line, the luminance varies in a direction such as to become lower than the initial characteristic. Application of a symmetric waveform causes a change plotted by the two-dot chain line to occur and hence can avoid such deterioration in performance involved in the case of application of an asymmetric waveform.

FIG. 18 schematically illustrates an electric circuit configuration of a driving circuit of a conventional EL display apparatus. The driving circuit configuration shown is basically equivalent to that disclosed in Japanese Examined Patent Publication JP-B2 6-34152 (1994) invented by Applicant of the instant application. Such a driving circuit provided in an EL display panel of the structure shown in FIG. 15 includes a data side driving IC 11 as a semiconductor integrated circuit for driving the transparent electrodes 2 as data side electrodes, and a scanning side driving IC 12 for driving back face electrodes 6 as scanning side electrodes. The data side driving IC 11 incorporates a shift register latch 13, and switching devices each comprising a pull-up element 14 and a pull-down element 15. Similarly, the scanning side driving IC 12 incorporates a shift register latch 16, and switching devices each comprising a pull-up element 17 and a pull-down element 18. The pull-up elements 14 and pull-down elements 15 of the data side driving IC 11 form an output circuit adapted to drive data electrodes 19. The pull-up elements 17 and pull-down elements 18 of the scanning side driving IC 12 form a driving circuit adapted to drive scanning electrodes 20.

The source electrodes of the pull-up elements 14 in the data side driving IC 11 are connected to a common line and applied with a positive modulating voltage of +Vm. Similarly, the source electrodes of the pull-down elements 15 are connected to a common line and are grounded to assume a GND potential. The drain electrode of each pair of pull-up element 14 and pull-down element 15 is connected to each data electrode 19. The data electrodes 19 consist of, for example, n electrodes X1, X2, X3, . . . , Xn, each of which are applied with a modulating voltage of Vm by the associated pull-up element 14 or pull-down element 15 in response to an image signal. The source electrodes of the pull-up elements 17 in the scanning side driving IC 12 are connected to a common line and supplied with a high positive voltage from a positive voltage supply circuit 21, which is also indicated at Pd1. The source electrodes of the pull-down elements 18 are connected to a common line and supplied with a high negative voltage from a negative voltage supply circuit 22, which is also indicated at Nd1. A diode 23 is provided between the positive voltage supply circuit 21 and the source electrodes of the pull-up elements 17. A diode 24 is provided between the negative voltage supply circuit 22 and the source electrodes of the pull-down elements 18. The diode 23 has an anode side connected to the positive voltage supply circuit 21 and a cathode side connected to the source electrodes of the pull-up elements 17. The cathode side of the diode 23 is also connected to the cathode side of a diode 25, and the anode side of the diode 25 is connected to the ground potential GND through a switching circuit 28 (Nd2). The diode 24 has an anode side connected to the source electrodes of the pull-down elements 18 and a cathode side connected to the negative voltage supply circuit 22. The anode side of the diode 24 is also connected to the anode side of a diode 26, and the cathode side of the diode 26 is connected to the ground potential GND through a switching circuit 27 (Pd2).

FIG. 19 schematically illustrates the configuration of a power supply circuit for generating a write voltage, which is a high voltage required to drive the EL display panel 10 shown in FIG. 18. A switching device 30 causes current on the primary side of a transformer 31 to be interrupted or passed. A pair of windings are provided on the secondary side of the transformer 31, and diodes 32 and 33 and capacitors 34 and 35 associated with the windings provide a smoothed positive voltage of +Vw and a smoothed negative voltage of −Vw. An output of the positive side diode 32 on its cathode side associated with the capacitor 34 is supplied to the anode of a diode 36, and the cathode side of the diode 36 is connected to the output side of transistors 39 and 40 controlled by a control circuit 38. When the transistors 39 and 40 are operated by the control circuit 38 so that a positive modulating voltage of +Vm is obtained from the output side thereof, an output of Vw+Vm as a positive write voltage is obtained on the cathode side of the diode 36.

The voltages of Vm and Vw, respectively, are established within the following ranges. Vm is a voltage for controlling the occurrence of luminescence of the EL display panel 10 and can assume any predetermined value lower than the luminescence initiating voltage. Vw is established to assume a value such that the sum of Vw and Vm is higher than the luminescence initiating voltage of the EL display panel 10 thereby ensuring a sufficient luminescence intensity.

FIG. 20 shows driving waveforms at different portions of data electrodes and scanning electrodes driven by the circuit shown in FIG. 18 in the case where the EL element on the point of intersection (X1,Y1) of X1 selected from the data electrodes 19 and Y1 selected from the scanning electrodes 20 is caused to give off light, while the EL element on the point of intersection (X2, Y1) of X2 selected from the data electrodes 19 and Y1 of the scanning electrodes 20 is not caused to give off light. In this case, what is called "frame reversal drive" is performed to apply well-symmetrized alternating pulses to the EL layer thereby realizing highly reliable display.

In the first frame, first, display data (Data) and clock (CkD) are sequentially inputted to the data side driving IC 11 and then transferred to a specified data electrode 19 with use of the shift register latch 13, followed by temporary latching of the display data using a latch strobe (LS). What is represented by N/R is an input terminal for specifying a direction in which display data is to be shifted. With the scanning electrodes 20 connected to the scanning side driving IC 12 being kept at a floating potential, pull-down elements 15 associated with those data electrodes 19 including X1 on which EL devices intended for luminescence lie are turned ON so that these associated data electrodes 19 assume the GND potential while pull-up elements 14 associated with those data electrodes 19 including X2 on which EL devices not intended for luminescence lie are turned ON to charge these associated data electrodes 19 up to a voltage of +Vm according to the data latched by the shift register latch 13 of the data side driving IC 11.

In turn, the pull-up element 17 of the scanning side driving IC 12 connected to Y1 of selected scanning electrodes 20 inputs a voltage of +(Vw+Vm) supplied from the positive voltage supply circuit 21 to the scanning electrode Y1 to raise the potential of Y1 up to +(Vw+Vm). As a result, the EL device on the point of intersection (X1,Y1) of the data electrode X1 and the scanning electrode Y1 is applied with a voltage of +(Vw+Vm), which is sufficient to cause luminescence, and hence gives off light. On the other hand, the EL device on the point of intersection (X2,Y1) of the data electrode X2 and the scanning electrode Y1 is applied with a voltage of Vw, which is insufficient to cause luminescence, and hence does not give off light.

Subsequently, all the data electrodes 19 (X1 through Xn) connected to the data side driving IC 11 are discharged to the ground potential GND by turning the pull-down elements 15 ON. Further, electric charge accumulated on the selected scanning electrode Y1 is discharged by means of the pull-down element 18 connected thereto and the switching circuit 27 so that the scanning electrode Y1 assume the ground potential GND. Thus, the driving operation with respect to the selected scanning electrode Y1 ends.

A similar driving operation is repeated with respect to scanning electrodes Y1 to Ym sequentially line by line to complete the driving operation in the first frame.

In the subsequent second frame, as in the first frame, display data (Data) and clock (CkD) are sequentially inputted to the data side driving IC 11 and then transferred to a specified location with use of the shift register latch 13, followed by temporary latching of the display data. With the scanning electrodes 20 connected to the scanning side driving IC 12 being kept at a floating potential, pull-up elements 14 associated with those data electrodes 19 including X1 on which EL devices intended for luminescence lie are turned ON so that these data electrodes 19 are charged up to a potential of +Vm while pull-down elements 15 associated with those data electrodes 19 including X2 on which EL devices not intended for luminescence lie are turned ON to have these data electrodes 19 assume the GND potential.

In turn, the pull-down element 18 connected to Y1 selected from the scanning electrodes 20 uses a voltage of −(Vw) supplied from the negative voltage supply circuit 22 to lower the potential of Y1 to −(Vw). As a result, the EL device on the point of intersection (X1,Y1) of the data electrode X1 and the scanning electrode Y1 is applied with a voltage of −(Vw+Vm), which is sufficient to cause luminescence, and hence gives off light. On the other hand, the EL device on the point of intersection (X2,Y1) of the data electrode X2 and the scanning electrode Y1 is applied with a voltage of Vw, which is insufficient to cause luminescence, and hence does not give off light. Subsequently, the pull-down elements 15 connected to all the data electrodes 19 (X1 through Xn) are turned ON to discharge the data electrodes 19 down to the GND potential. Further, the selected scanning electrode Y1 is discharged down to the GND potential by means of the pull-up element 17 connected thereto and the switching circuit 28. Thus, the driving operation with respect to the selected scanning electrode Y1 ends.

A similar driving operation is repeated with respect to scanning electrodes Y1 to Ym sequentially line by line to complete the driving operation in the second frame. Alternating the first frame operation and the second frame operation makes it possible to apply positive and negative alternating pulses to the EL display panel 10 thereby displaying a desired image.

Japanese Examined Patent Publication JP-B2 2619001 discloses a method of correcting a change in luminance depending on the number of pixels giving off light and the gray scale level in a gray scale display by varying a modulating voltage or adjusting the time period for which a modulating voltage is applied, or by any other means in accordance with gray scale data. According to this prior art reference, the modulating voltage to be applied to a data electrode is varied based on the sum total of luminescent loads found from the gray scale data.

FIG. 21 shows driving waveforms used in the gray scale display disclosed in JP-B2 2619001. In this prior art technique, the time period for which a capacitor is charged is determined in accordance with the gray scale data for each pixel and, therefore, the capacitor is more charged to provide a higher write voltage as the number of pixels intended for luminescence increases to provide a brighter gray scale level. Thus, it is possible to correct the luminance in accordance with an increase in load.

In the driving circuit of the conventional EL display panel 10 shown in FIG. 18, the GND potential and the positive voltage of +Vm are used as modulating voltages to be applied from the data side through the data side driving IC 11 and, hence, the waveforms of the voltages applied to the EL display panel 10 are not symmetric. In order to correct such a symmetric waveforms into symmetric waveforms, the absolute value of amplitude of a driving voltage to be applied to a data electrode 19 from the scanning side driving IC 12 needs to be changed depending upon whether the voltage to be applied to the data electrode 19 is of positive or negative polarity. In FIG. 20, for instance, a positive voltage having an amplitude of Vw+Vm is applied to the scanning electrode Y1 in the first frame, whereas a negative voltage having an amplitude of −Vw is applied thereto in the second frame. This results in the design of the power supply circuit made intricate or a like problem. Further, the withstand voltage of a decoupling part connected to the power supply line and that of a bypass capacitor need to be changed depending upon whether they are on the positive side or the negative side. This results in a difficulty in the management of parts or an increase in the cost of parts if they are rendered common based on a voltage amplitude of a higher absolute value.

The aforementioned correction in a gray scale display is performed to correct a change in the voltage applied to a pixel intended for luminescence light due to influences of the ON resistance of an output device, wiring resistance of electrodes or the like that vary in accordance with the number of pixels giving off light on each scanning side electrode and the level of gray scale. The correction is achieved by increasing or decreasing the write voltage of positive or negative polarity. For this reason, it is possible that the symmetry of applied voltages is impaired. If the symmetry of applied voltages is impaired due to the gray scale correction, a change in the applied voltage-luminance characteristic is likely to occur as shown in FIG. 16 after the apparatus has been driven for a long time and such a change causes the display quality to be degraded. For this reason, such a gray scale correction cannot be said to be a desirable correction from the viewpoint of long-term reliability.

SUMMARY OF THE INVENTION

An object of the invention is to provide an electroluminescent display apparatus having simplified peripheral circuitry which is driven with well-symmetrized driving waveforms and imparted with higher long-term reliability.

The invention provides an electroluminescent display apparatus comprising:

a first group of electrodes;

a second group of electrodes, the first group of electrodes and second group of electrodes being arranged to extend in respective directions intersecting each other;

an electroluminescent layer sandwiched between the first group of electrodes and the second group of electrodes;

a first driving circuit, connected to the first group of electrodes, for applying a modulating voltage of positive or negative polarity to the first group of electrodes through output terminals thereof; and a second driving circuit, connected to the second group of electrodes, for applying write voltages of positive or negative polarity, having an equal absolute value, to the second group of electrodes through output terminals thereof, or capable of switching a potential of the second group of electrodes to either a ground potential or a floating potential.

According to the invention, the second driving circuit applies a positive write voltage or a negative write voltage which have an equal absolute value to the second group of electrodes and, hence, a simplified power supply circuit for supplying such write voltages is realized with the result that the peripheral circuitry can be simplified.

In the invention it is preferable that the absolute value of the write voltage is selected to be larger than that of a voltage that initiates luminescence of the electroluminescent layer and lower than a luminescence voltage at which the electroluminescent layer is in a luminance saturation zone; and the modulating voltage is of such a magnitude that a sum of the modulating voltage and the write voltage increases up to the luminescence voltage within the luminance saturation zone while a difference obtained by subtracting the modulating voltage from the write voltage decreases from the luminescence initiating voltage to a voltage within a predetermined range.

According to the invention, the absolute value of the write voltage is selected so as to be larger than that of the voltage that initiates luminescence of the electroluminescent layer and lower than a luminescence voltage at which the electroluminescent layer is in a luminance saturation zone and, hence, the write voltage is higher than the modulating voltage. Since the positive and negative write voltages which are on the higher voltage side are well-symmetrized, it is possible to use capacitors or like components having a common withstand voltage for both the positive and negative polarities of the write voltage in the peripheral circuitry. Further, since a maximum value of the write voltage can be decreased as compared with that of an asymmetric write voltage, the required withstand voltage rank is likely to lower. Such a lowered withstand voltage rank makes reductions in cost and size possible.

In the invention it is preferable that the write voltage is selected to be a mid-voltage between the luminescence initiating voltage and the luminescence voltage, and the modulating voltage is selected so that a maximum value thereof is ½ as large as the difference between the luminescence initiating voltage and the luminescence voltage.

According to the invention, the luminance of luminescence can be raised by increasing the sum of the write voltage and the modulating voltage as a voltage to be applied to the electroluminescent layer, to the luminescence voltage, or the luminance can be lowered by decreasing the difference obtained by subtracting the modulating voltage from the write voltage, to around the luminescence initiating voltage. Further, the maximum value of the modulating voltage can be minimized in a range in which a change in luminance is larger, whereby the peripheral circuitry of the first driving circuit and the like can be simplified.

In the invention it is preferable that the first driving circuit is capable of varying the modulating voltage according to a signal inputted there to and outputting the modulating voltage thus varied.

According to the invention, a voltage to be outputted as the modulating voltage from the first driving circuit can be varied according to a signal inputted to the driving circuit, whereby a gray scale display can be achieved easily.

The invention provides an electroluminescent display apparatus comprising:

a first group of electrodes;

a second group of electrodes, the first group of electrodes and second group of electrodes being arranged to extend in respective directions intersecting each other;

an electroluminescent layer sandwiched between the first group of electrodes and the second group of electrodes, points of intersection of the first group of electrodes and the second group of electrodes being driven with pulse waveforms to serve as pixels and display a gray scale image;

a first driving circuit having output terminals connected to respective ones of the first group of electrodes and capable of applying a modulating voltage of positive or negative polarity to each of the first group of electrodes;

a second driving circuit having output terminals connected to respective ones of the second group of electrodes and capable of switching each of the second group of electrodes between a state applied with a write voltage of positive or negative polarity and a state applied with a ground potential or a floating potential; and a correction circuit for computing display data indicative of a gray scale level for each of the pixels formed on the second group of electrodes line by line in the direction in which the second group of electrodes are arranged and varying a pulse width of a voltage waveform to be applied to each of the pixels on each line in accordance with the display data computed.

According to the invention, the first group of electrodes and the second group of electrodes, which are arranged to extend in respective directions which intersect each other and sandwich the electroluminescent layer therebetween, are driven by the first driving circuit and the second driving circuit, respectively. Each of the first group of electrodes is driven by being applied with a modulating voltage of positive or negative polarity by the first driving circuit. The second driving circuit is capable of switching each of the second group of electrodes between a state applied with a write voltage of positive or negative polarity and a state applied with a ground potential or a floating potential. Since the positive and negative voltages applied to each pixel by the first and second driving circuits have an equal absolute value, the symmetry of the voltages with respect to the polarity can be maintained. The correction circuit is configured to compute display data indicative of a gray scale level for each of the pixels formed on the second group of electrodes line by line in the direction in which the second group of electrodes are arranged and to vary a pulse width of a voltage waveform to be applied to each of pixels on each line in accordance with the display data computed. Accordingly, it is possible to realize a display with an even luminance regardless of a variation in the number of pixels giving off light by increasing the pulse width when the number of such pixels is large or decreasing the pulse width when the number of such pixels is small even when such pixels are at the same gray scale level.

In the invention it is preferable that the correction circuit is configured to vary the pulse width of the voltage waveform of at least one of the modulating voltage to be applied from the first driving circuit and the write voltage to be applied from the second driving circuit.

According to the invention, since the pulse width of the voltage waveform of at least one of the modulating voltage to be applied from the first driving circuit and the write voltage to be applied from the second driving circuit can be varied, the pulse width of the voltage waveform applied to each pixel also can be varied thereby enabling a correction for even luminance according to an increase or decrease in load.

In the invention it is preferable that the correction circuit is configured to vary relative timing between the modulating voltage to be applied from the first driving circuit and the write voltage to be applied from the second driving circuit.

According to the invention, the correction circuit varies relative timing between the modulating voltage to be applied from the first driving circuit and the write voltage to be applied from the second driving circuit and, hence, an overlap of the waveform of the modulating voltage and the waveform of the write voltage is varied with respect to time in applying the modulating voltage and the write voltage to each pixel and such a variation is equivalent to a variation in the pulse width of a voltage waveform for driving the pixel. Thus, a correction for an even luminance accommodating a variation in load can be achieved.

In the invention it is preferable that the correction circuit is configured to vary the pulse width of a voltage waveform to be applied to each of the pixels on each line equally with respect to positive polarity and negative polarity.

According to this feature of the invention, the correction circuit varies the pulse width of a positive voltage waveform and that of a negative voltage waveform to be applied to each pixel equally and, hence, each pixel can be driven equally and symmetrically on the positive and negative sides in terms of not only voltage but also time, whereby the long-term reliability of the apparatus can be enhanced.

In the invention it is preferable that the correction circuit is configured to compute all or part of the gray scale data and vary the pulse width of a voltage waveform to be applied to each pixel according to all or part of the gray scale data computed.

According to this feature of the invention, the correction circuit computes all or part of gray scale data and varies the pulse width of a voltage waveform to be applied to each pixel according to all or part of the gray scale data computed, thereby achieving a simplified correction.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
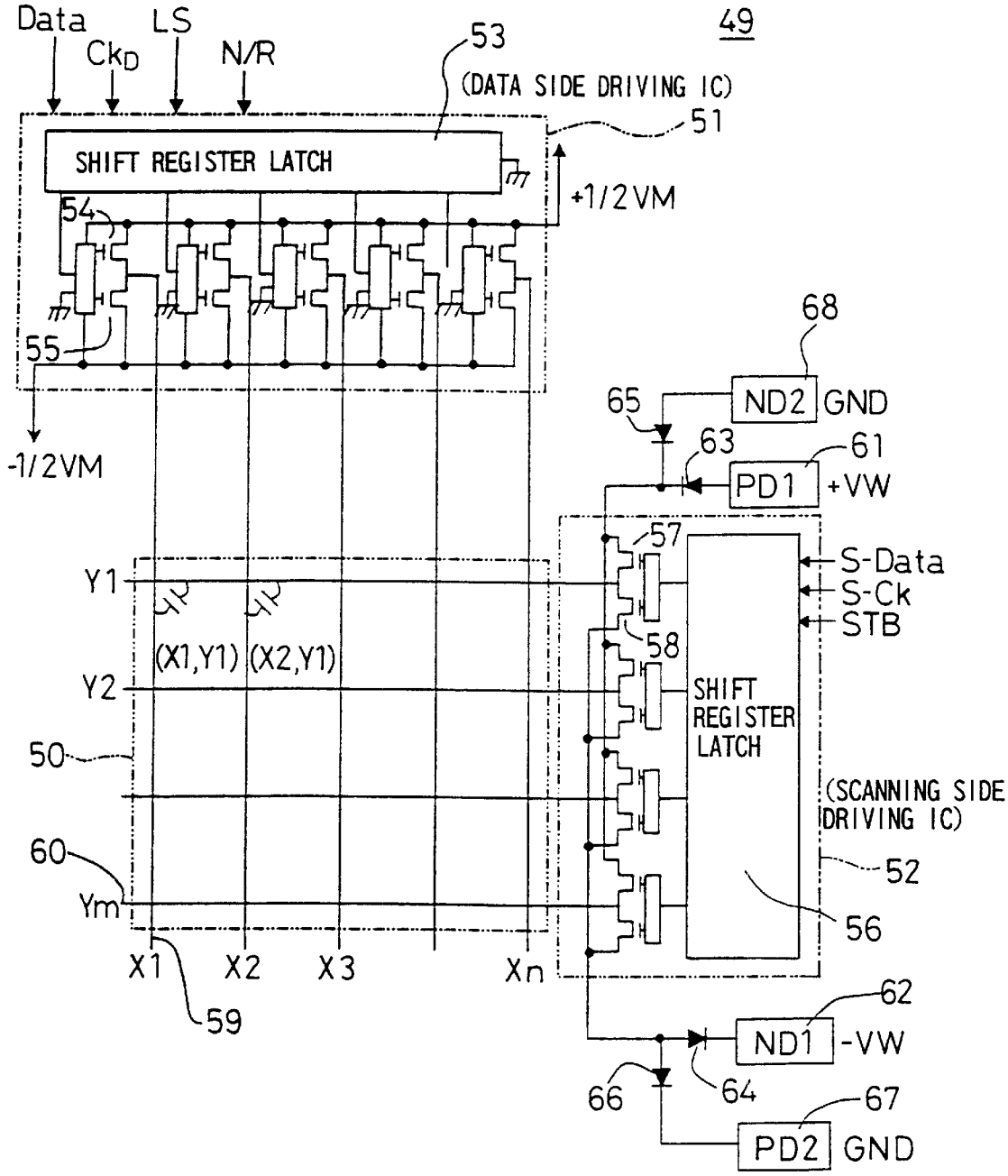
FIG. 1 is a block diagram schematically showing the electric circuit configuration of a driving circuit 49 of an EL display apparatus as an embodiment of the invention.

Now referring to the drawings, preferred embodiments of the invention are described below.

Figure 15:
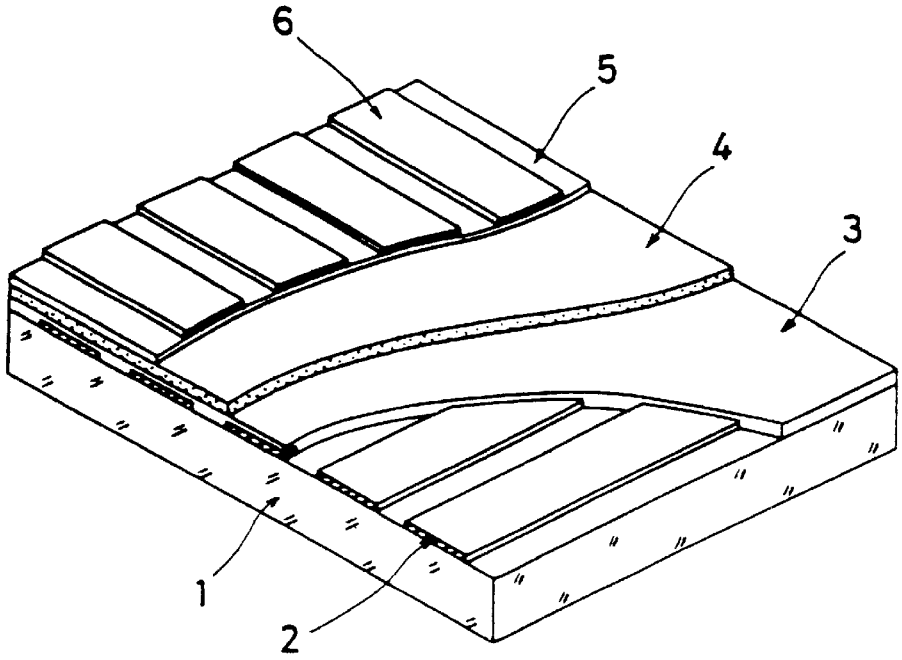
FIG.15 Prior Art
FIG. 15 is a view illustrating the basic configuration of an EL display panel.
Figure 16:
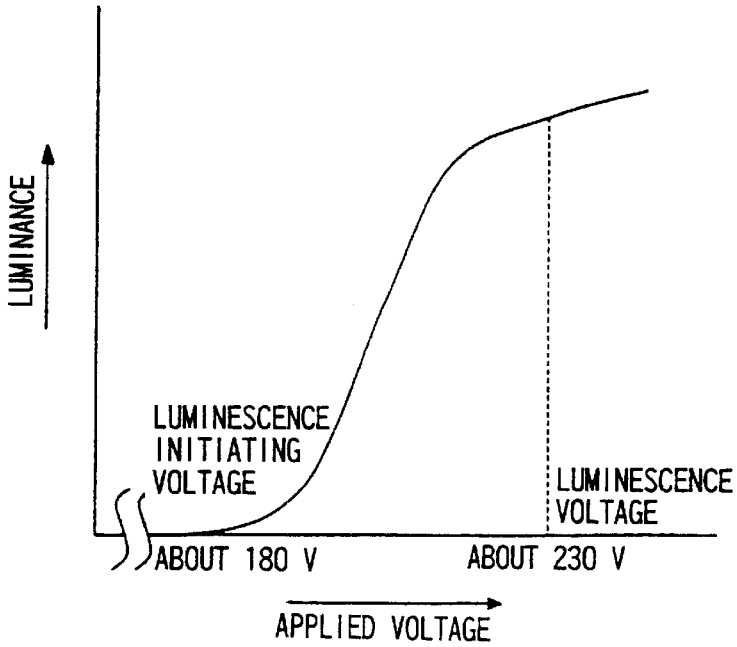
FIG.16 Prior Art
FIG. 16 is a graph showing the relationship between the luminance and the applied voltage in the EL display panel shown in FIG. 15.
Figure 17:
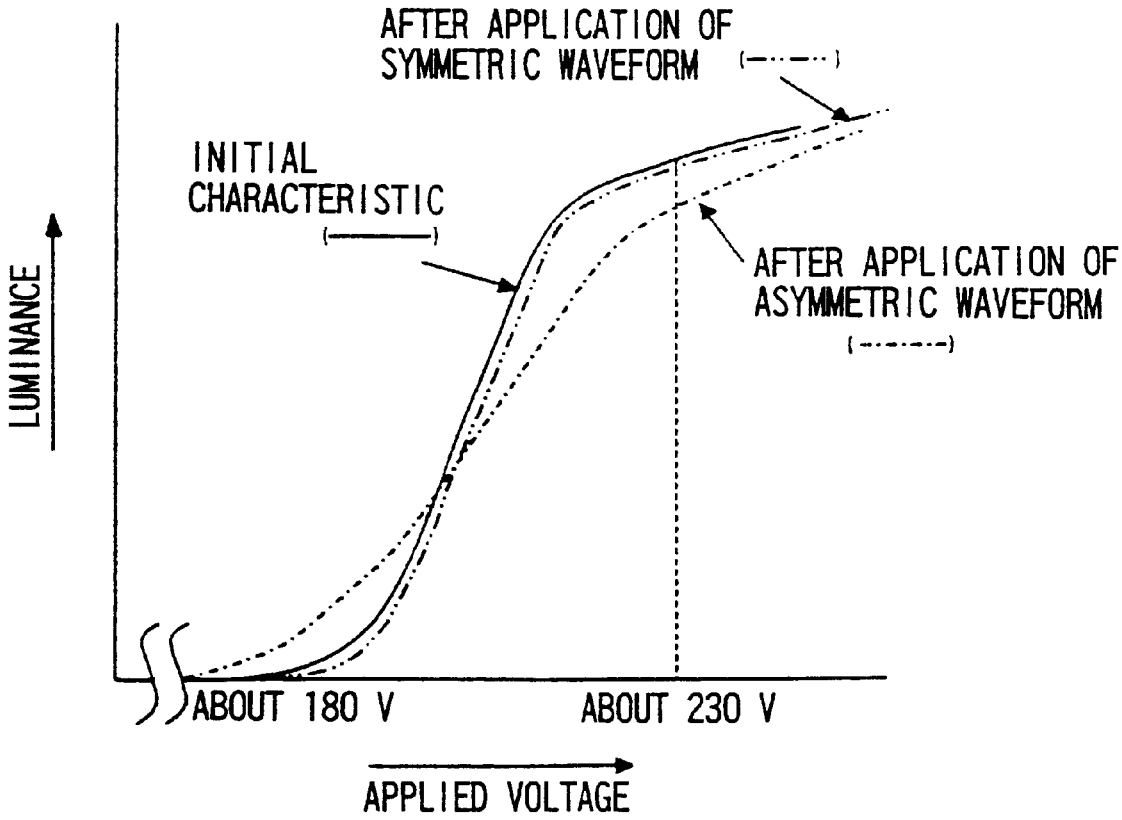
FIG.17 Prior Art
FIG. 17 is a graph showing a change with time in the relationship between the luminance and the applied voltage in the EL display panel.

FIG. 1 is a schematic illustration showing the electric circuit of a driving circuit 49 of an EL display apparatus as one embodiment of the invention. The driving circuit 49 of the EL display apparatus drives an EL display panel 50 having a basic structure shown in FIG. 15 by means of a data side driving IC 51 and a scanning side driving IC 52. The data side driving IC 51 employs an IC of a double well structure recently put into practice and hence differs from the corresponding one shown in FIG. 18 in that it charges data side electrodes 59 with a positive or negative modulating voltage. The scanning side driving IC 52, on the other hand, is basically equivalent to a scanning side driving IC 12 shown in FIG. 18. The data side driving IC 51 includes a shift register latch 53 and pairs of pull-up element 54 and pull-down element 55. The scanning side driving IC 52 includes a shift register latch 56 and pairs of pull-up element 57 and pull-down element 58. The data side driving IC 51 and the scanning side driving IC 52 drive the data electrodes 59 and the scanning electrodes 60, respectively, of the EL display panel 50 line by line.

Figure 2:
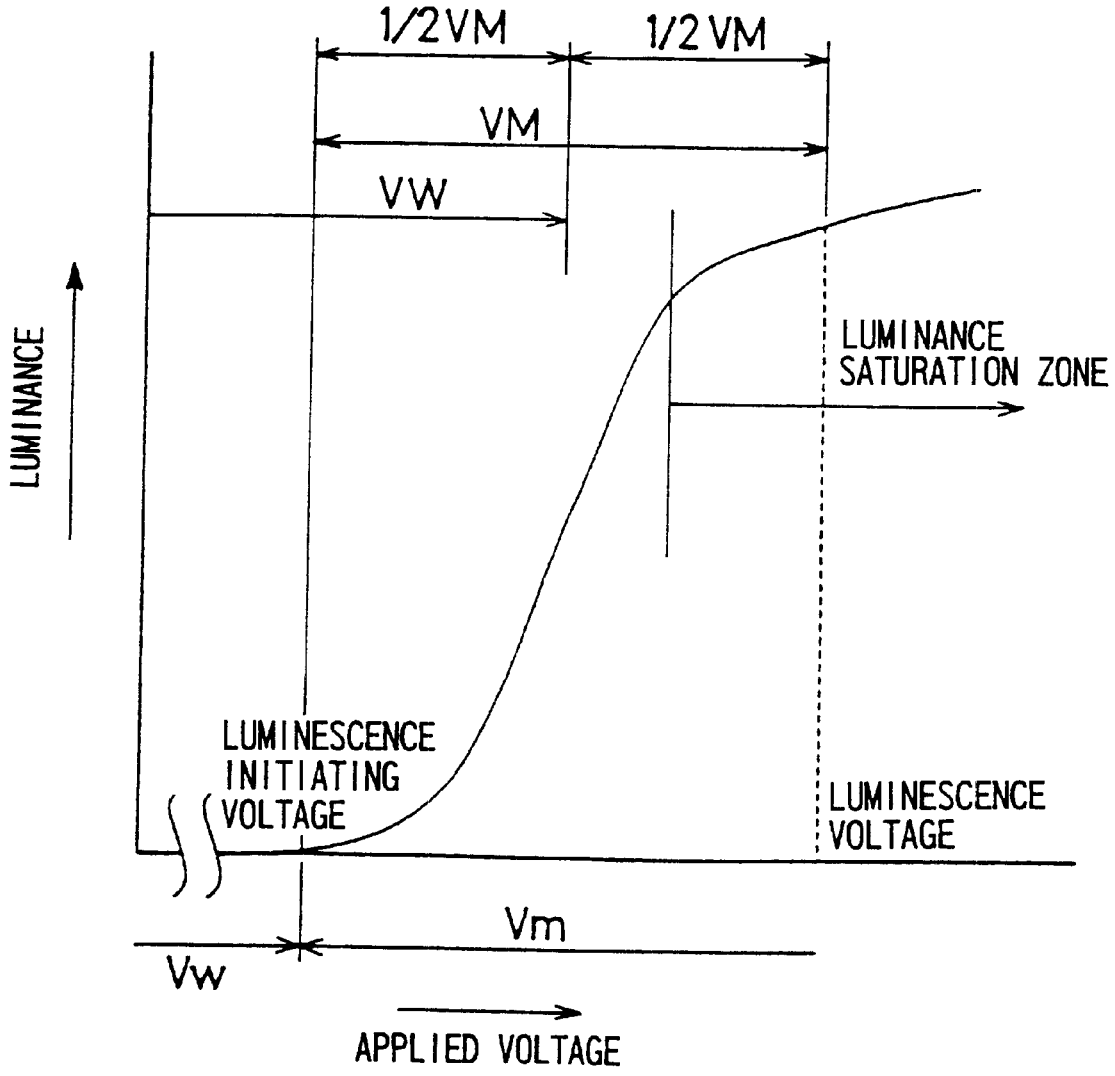
FIG. 2 is a graph showing the relationship between relevant voltages in driving EL display apparatus 50 by means of the driving circuit 49 of the EL display apparatus shown in FIG. 1.

FIG. 2 is a graph showing the relationships among relevant voltages when driving the EL display panel 50 using the driving circuit 49 of the EL display apparatus shown in FIG. 1. About the curve showing the relationship between the voltage applied to the EL layer and the respective levels of luminance, the absolute value of a write voltage VW is selected in the middle between a luminescence initiating voltage and a luminescence voltage taken in a luminance saturation range. The luminance saturation range is the range of applied voltage higher than an inflection point of a luminance-applied voltage characteristic curve of an EL display panel, where a positive sharp slope of luminance becomes dull compared to a constant increase of applied voltage. The voltage difference between the luminescence voltage and the luminescence initiating voltage is herein represented by "VM". With a conventional driving circuit shown in FIG. 18, a writing voltage of Vw becomes approximately the level of the luminescence initiating voltage, while a modulating voltage of Vm is substantially equal to the difference between the luminescence voltage and the luminescence initiating voltage, which is represented by the voltage VM in the subject embodiment. The modulating voltage applied in the subject embodiment is a voltage having an absolute value of ½VM and polarities switched between positive and negative.

As shown in FIG. 1, a source electrode, to which a plurality of pull-up elements 54 of the data side driving IC 51 of this embodiment are connected, is applied with a voltage of +½VM. A source electrode, to which a plurality of pull-down elements 55 are connected, is applied with a voltage of −½VM. Thus, each pair of pull-up element 54 and pull-down element 55 of the data side driving IC 51 is capable of switchably applying a voltage of absolute value ½VM to a data electrode 59 connected thereto with either a positive or a negative voltage.

A source electrode, to which a plurality of pull-up elements 57 of the scanning side driving IC 52 are connected, is supplied with a positive voltage of VW from a positive voltage supply circuit 61 that is also represented as PD1. A source electrode of a plurality of pull-down elements 58 is supplied with a negative voltage of −VW from a negative voltage supply circuit 62 that is also represented as ND1. The positive voltage supply circuit 61 and the negative voltage supply circuit 62 are connected to the source electrode of the pull-up elements 57 and the source electrode of the pull-down elements 58, respectively, via respective diodes 63 and 64. The portion connecting the cathode of the diode 63 to the source electrode of the pull-up elements 57 is also connected to the cathode of the diode 65. The anode of the diode 65 is connected to a ground potential GND through a switching circuit 68 (ND2). The portion connecting the anode of the diode 64 to the source electrode of the pull-down elements 58 is also connected to the anode of the diode 66. The cathode of the diode 66 is connected to the ground potential GND through a switching circuit 67 (PD2).

Figure 3:
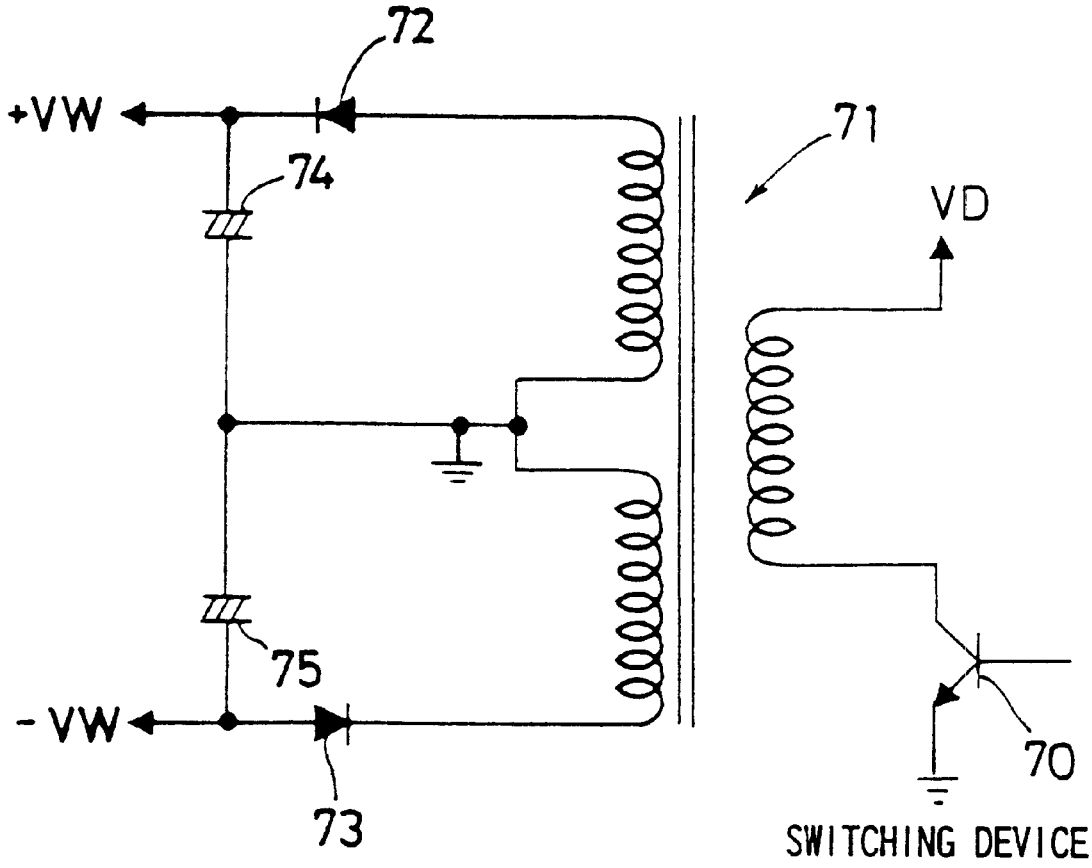
FIG. 3 is a simplified electric circuit diagram showing a power supply circuit for the driving circuit of the EL display apparatus shown in FIG. 1.
Figure 19:
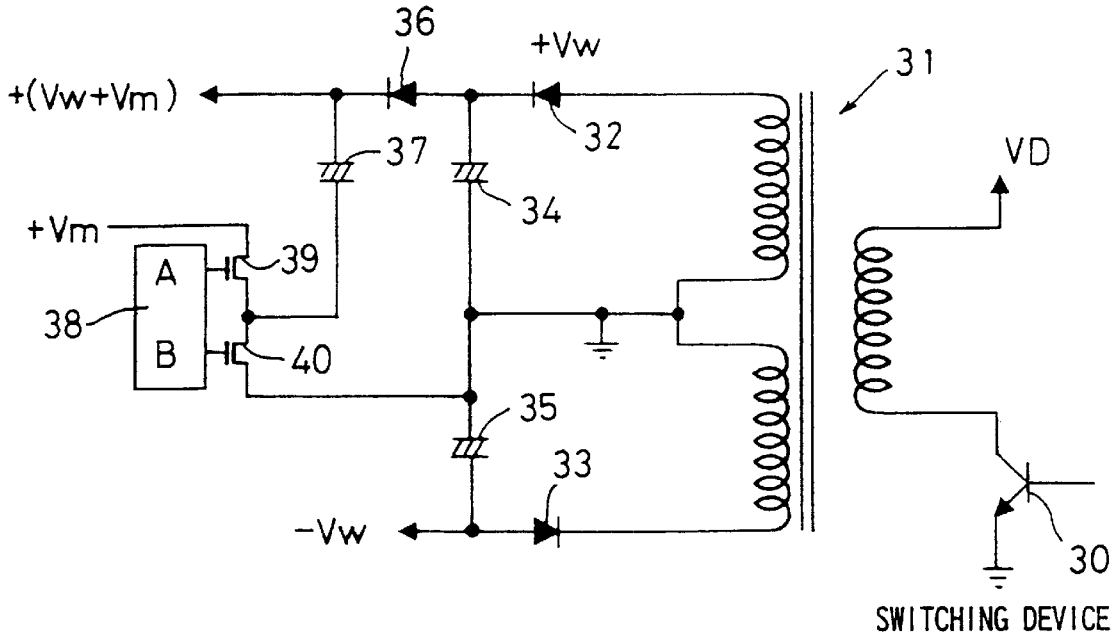
FIG.19 Prior Art
FIG. 19 is a simplified electric circuit diagram of a power supply for supplying a source voltage to the driving circuit of the EL display apparatus shown in FIG. 18.
Figure 20:
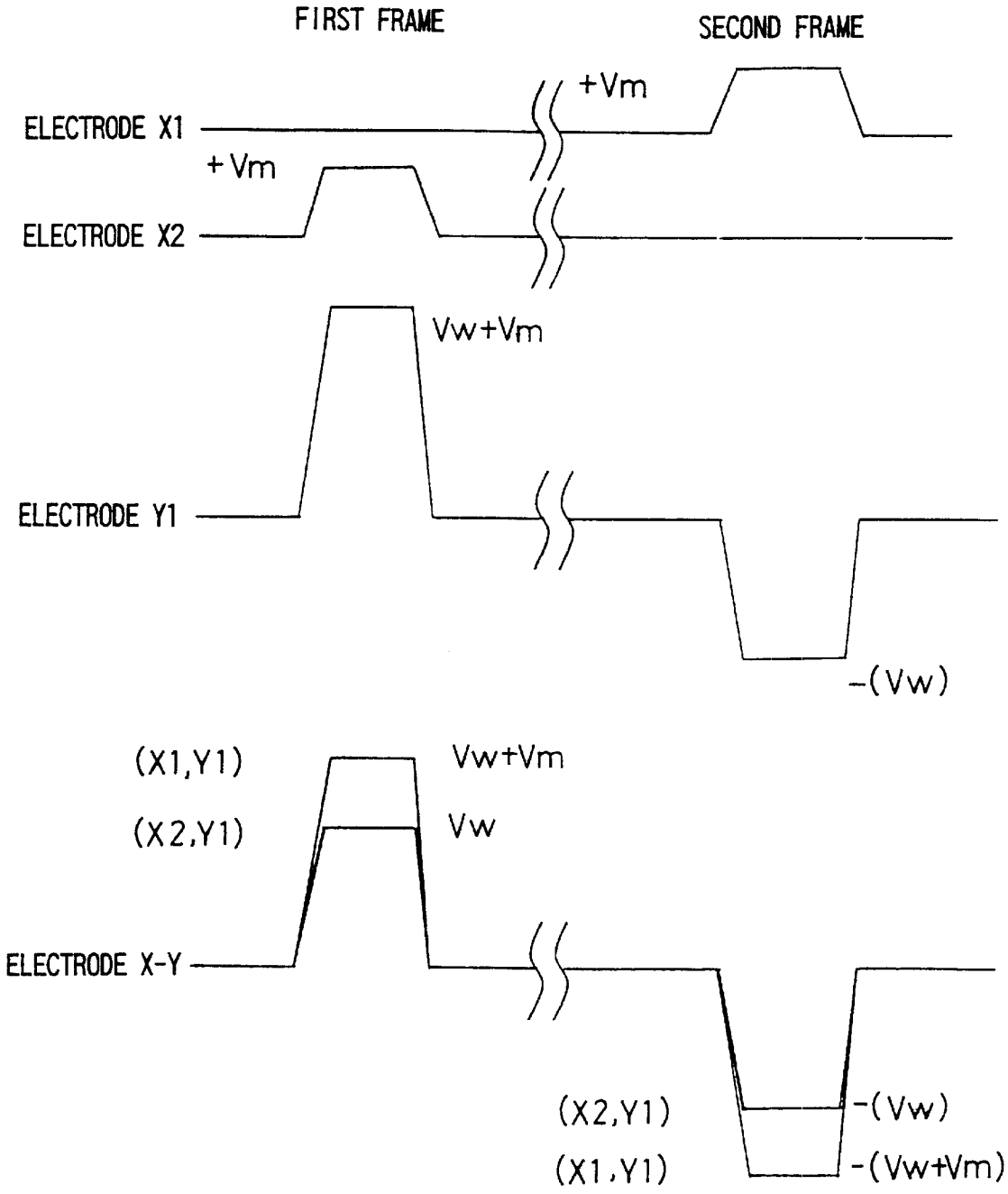
FIG.20 Prior Art
FIG. 20 is a time chart showing exemplary driving waveforms used to drive an EL display apparatus 10 by means of the driving circuit of the EL display apparatus shown in FIG. 18.
Figure 21:
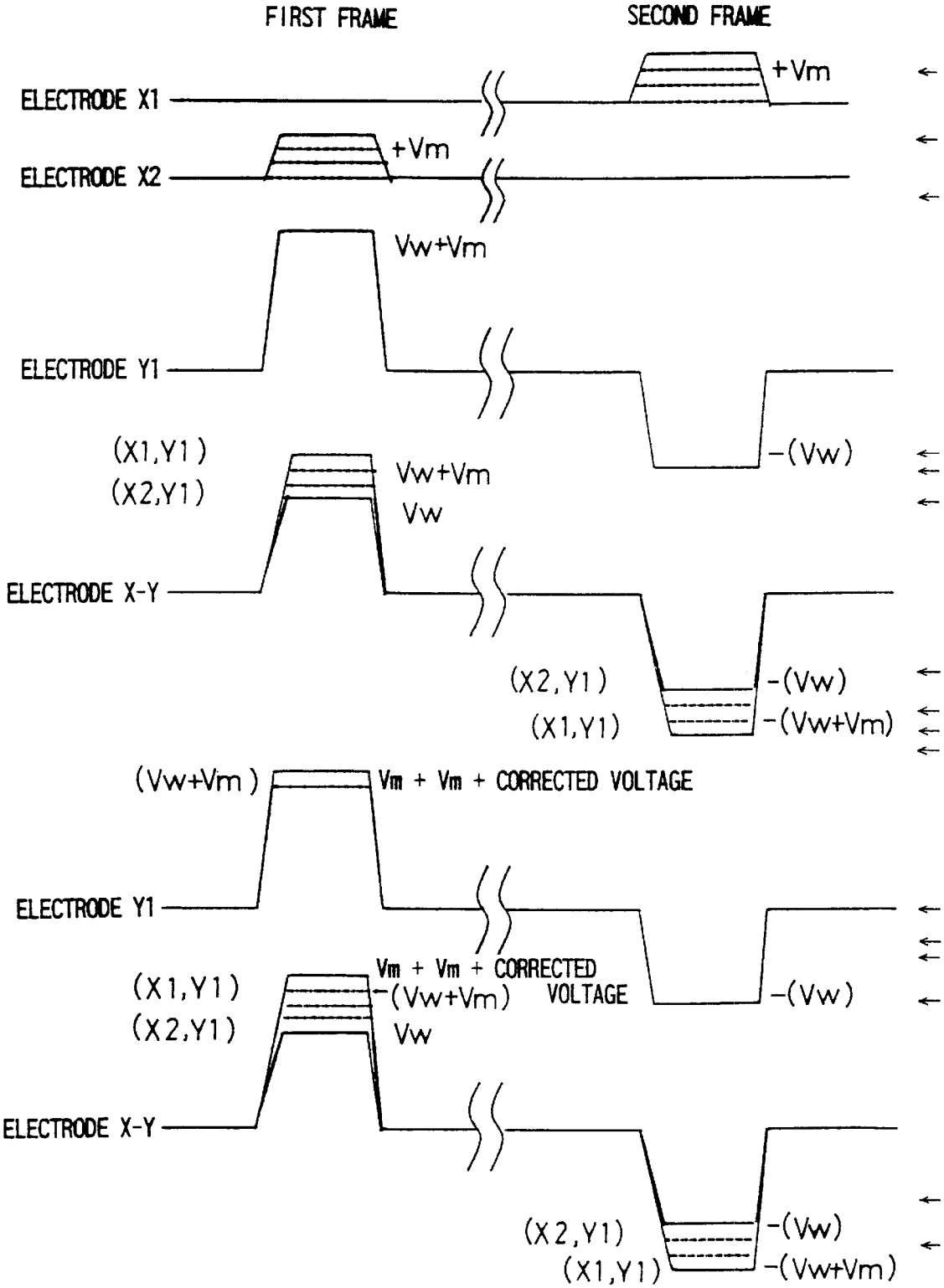
FIG.21 Prior Art
FIG. 21 is a time chart showing driving voltage waveforms used to provide a corrected gray scale display according to the prior art.

FIG. 3 is a simplified electric circuit diagram showing a power supply circuit for supplying a voltage required for the scanning side driving IC 52 on the higher voltage side in the driving circuit 49 of the EL display apparatus shown in FIG. 1. A switching device 70 is provided to switch current flow ON or OFF on the primary side of a transformer 71. A positive voltage of +VW and a negative voltage of −VW can be generated from a pair of windings on the secondary side of the transformer 71 through respective diodes 72 and 73 each rectifying current and respective capacitors 74 and 75 each smoothing current. It can be understood from comparison with FIG. 19 that the power supply circuit shown in FIG. 3 is highly simplified.

Figure 4:
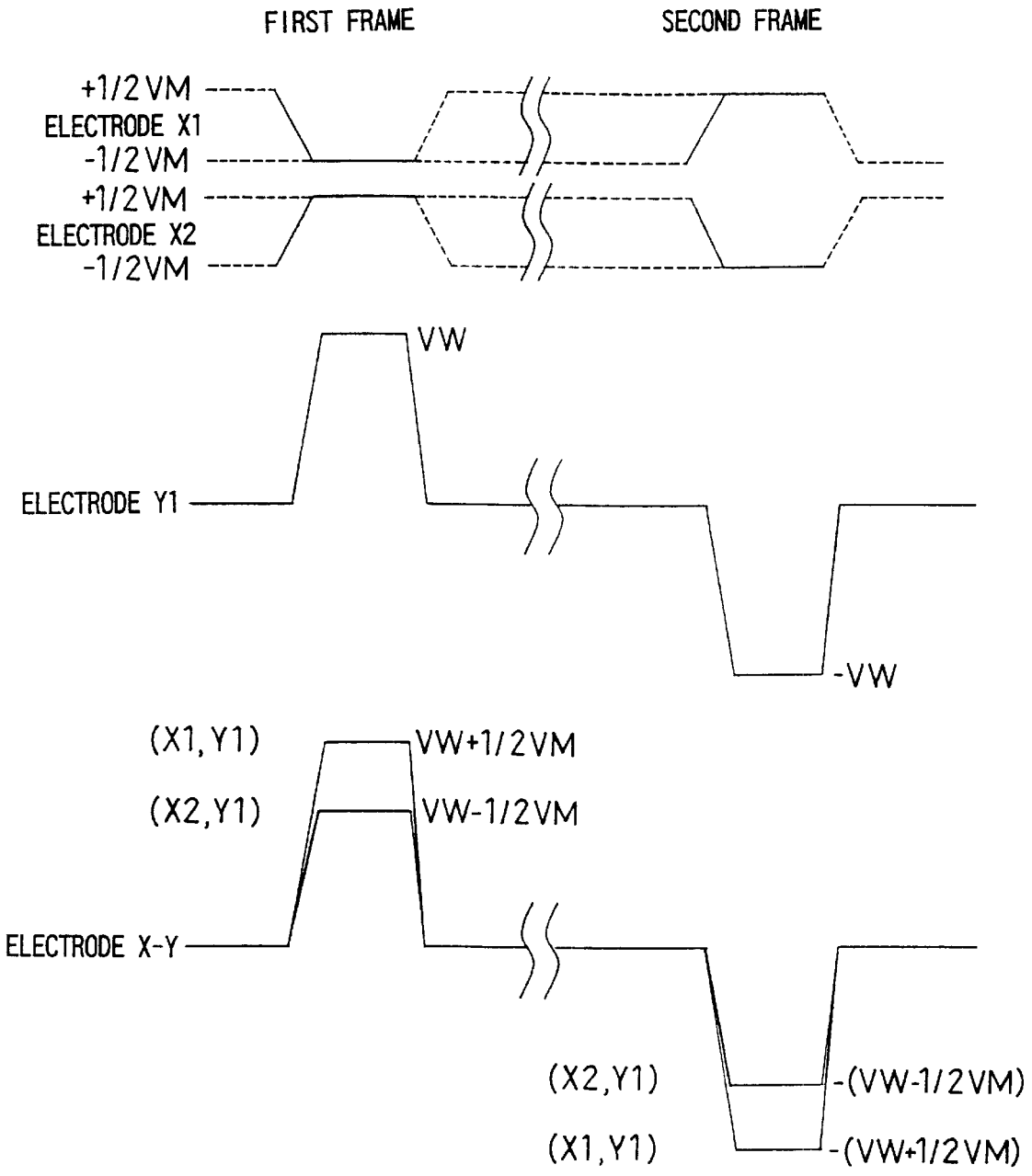
FIG. 4 is a time chart showing exemplary driving waveforms used to drive the EL display apparatus 50 by means of the driving circuit 49 of the EL display apparatus shown in FIG. 1.

FIG. 4 shows driving pulse shapes when voltage is applied in the case where an EL element at the intersection (X1,Y1) of X1 which is one of the n data electrodes 59 and Y1 which is one of the m scanning electrodes 60 in the driving circuit shown in FIG. 1 emits light, while an EL element at the intersection (X2,Y1) of X2 of the data electrodes 59 and Y1 of the scanning electrodes 60 does not emit light.

In the first frame, first, display data (Data) and clock ($Ck_D$) are sequentially input to the data side driving IC 51 and then transferred to the location of a specified data electrode 59 with use of the shift register latch 13, followed by temporary latching of the display data. With the scanning electrodes 60 connected to the scanning side driving IC 52 being kept at a floating potential, pull-down elements 55 connected to the data electrodes 59 including X1 on which EL devices to be illuminated are available are turned ON according to the data latched by the shift register latch 53, and a voltage having a potential of −½VM is applied. Pull-up elements 54 connected to the data electrodes 59 such as X2 on which EL devices not to be illuminated are available are turned ON and these data electrodes 59 are charged up to +½VM.

Then, a voltage of +VW supplied from the positive voltage supply circuit 61 is inputted to Y1 selected among the scanning electrodes 60 through the pull-up element 57 of the scanning side driving IC 52 connected to Y1 to raise the potential of Y1 up to +VW. As a result, the EL device at the intersection (X1,Y1) of the data electrode X1 and the scanning electrode Y1 is applied with a voltage of +(VW+½VM), which is sufficient to cause luminescence, and hence the EL device emits light. On the other hand, the EL device at the intersection (X2,Y1) of the data electrode X2 and the scanning electrode Y1 is applied with a voltage of +(VW−½VM), which is not as much as causing luminescence, and hence the EL device does not emit light. Next, the scanning electrode Y1 is discharged to the GND potential by turning the respective pull-down element 58 and switching circuit 67 ON, thereby ending the driving operation with respect to Y1 selected among the scanning electrodes 60. A similar driving operation is repeated for the scanning electrodes Y1 to Ym sequentially line by line to complete the driving operation with respect to the first frame.

In the second frame, as in the case of first frame, display data (Data) and clock (CkD) are sequentially inputted into the data side driving IC 51 and then transferred to a specified location with use of the shift register latch 53, followed by temporary latching of the data. With the scanning electrodes 60 connected to the scanning side driving IC 52 being kept at a floating potential, pull-up elements 54 connected to the data electrodes 59 including X1 on which EL devices to be illuminated are available are turned ON according to the data latched by the shift register latch 53, and the data electrodes 59 are charged up to a potential of +½VM. Pull-down elements 55 connected to the data electrodes 59 including X2 on which EL devices not to be illuminated are turned ON, where the data electrodes 19 have a potential of −½VM.

Then, Y1 selected among the scanning electrodes 60 is applied with a negative voltage of −VW supplied from the negative voltage supply circuit 62 to lower the potential of Y1 to −VW. As a result, the EL device at the intersection (X1,Y1) of the data electrode X1 and the scanning electrode Y1 is applied with a voltage of −(VW+½VM), which is sufficient to cause luminescence, and hence the EL device emits light. On the other hand, the EL device at the intersection (X2,Y1) of the data electrode X2 and the scanning electrode Y1 is applied with a voltage of −(VW−½VM), which is not as much as causing luminescence, and hence the EL device does not emit light.

Further, the scanning electrode Y1 is discharged to the GND potential by turning ON the pull-up element 57 connected thereto and the switching circuit 68, ending the driving operation with respect to the selected scanning electrode Y1. A similar driving operation is repeated for the scanning electrodes Y1 to Ym sequentially line by line to complete the driving operation with respect to the second frame. Repeating the above driving operations line by line, alternately performing the first and second frame sequences, makes it possible to apply alternating pulses of having positive or negative polarity to the EL display panel 50, and thereby displaying a desired image.

Figure 5:
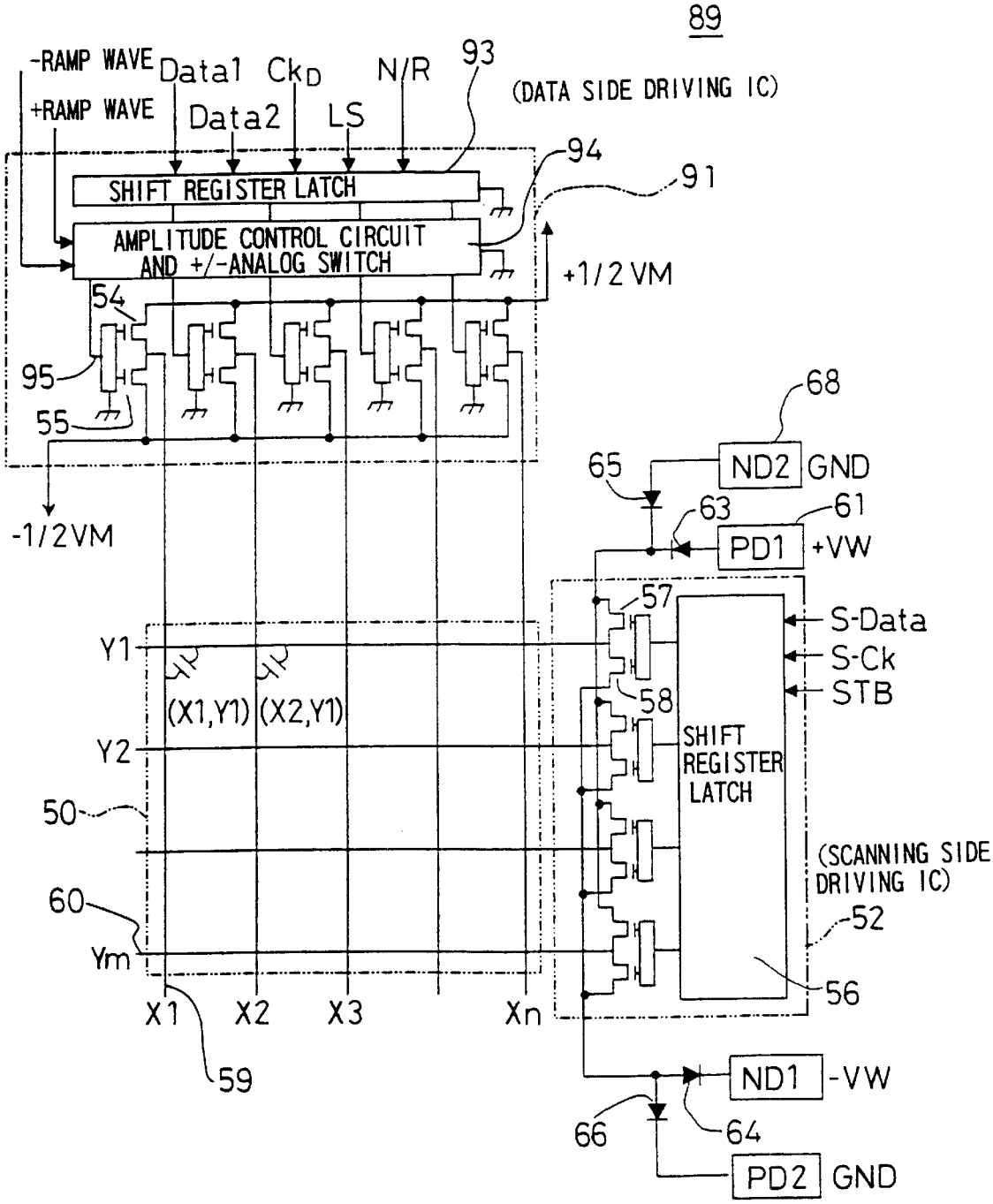
FIG. 5 is a block diagram schematically showing the electric circuit configuration of a driving circuit 89 of an EL display apparatus as another embodiment of the invention.

FIG. 5 is a schematic illustration showing the electric circuit of a driving circuit 89 of an EL display apparatus as another embodiment of the invention. Parts corresponding to ones for the embodiment represented by FIG. 1 are given the same reference characters, where repetition of same descriptions is avoided. Similarly to the former embodiment shown in FIG. 1, the subject embodiment employs an EL display panel 50 and drives data electrodes 59 by means of data side driving IC 91. Scanning electrodes 60 are driven by means of scanning side driving IC 52 which is similar to that shown in FIG. 1. A shift register latch 93 included in the data side driving IC 91 inputs display data (Data 1 and Data 2) consisting of two bits in the data side driving IC 91 and then latches data for one line. Thereafter, a voltage level on the halfway through to the ON voltage from the OFF voltage can be selected as the gate voltage of pull-up element 54 and pull-down element 55 according to a combination of 2-bit data items by an amplitude control circuit and +/−analog switch 94 using ramp wave. Thus, it is possible to output voltages selecting not only from either −½VM or +½VM but also from voltages of half level of these two voltages. The number of such selectable output voltages can be increased by increasing the number of bits in an input data. Further, it is also possible to output a voltage generated utilizing the amplitude of the analog data input in cases where inputted data is analog.

Figure 6:
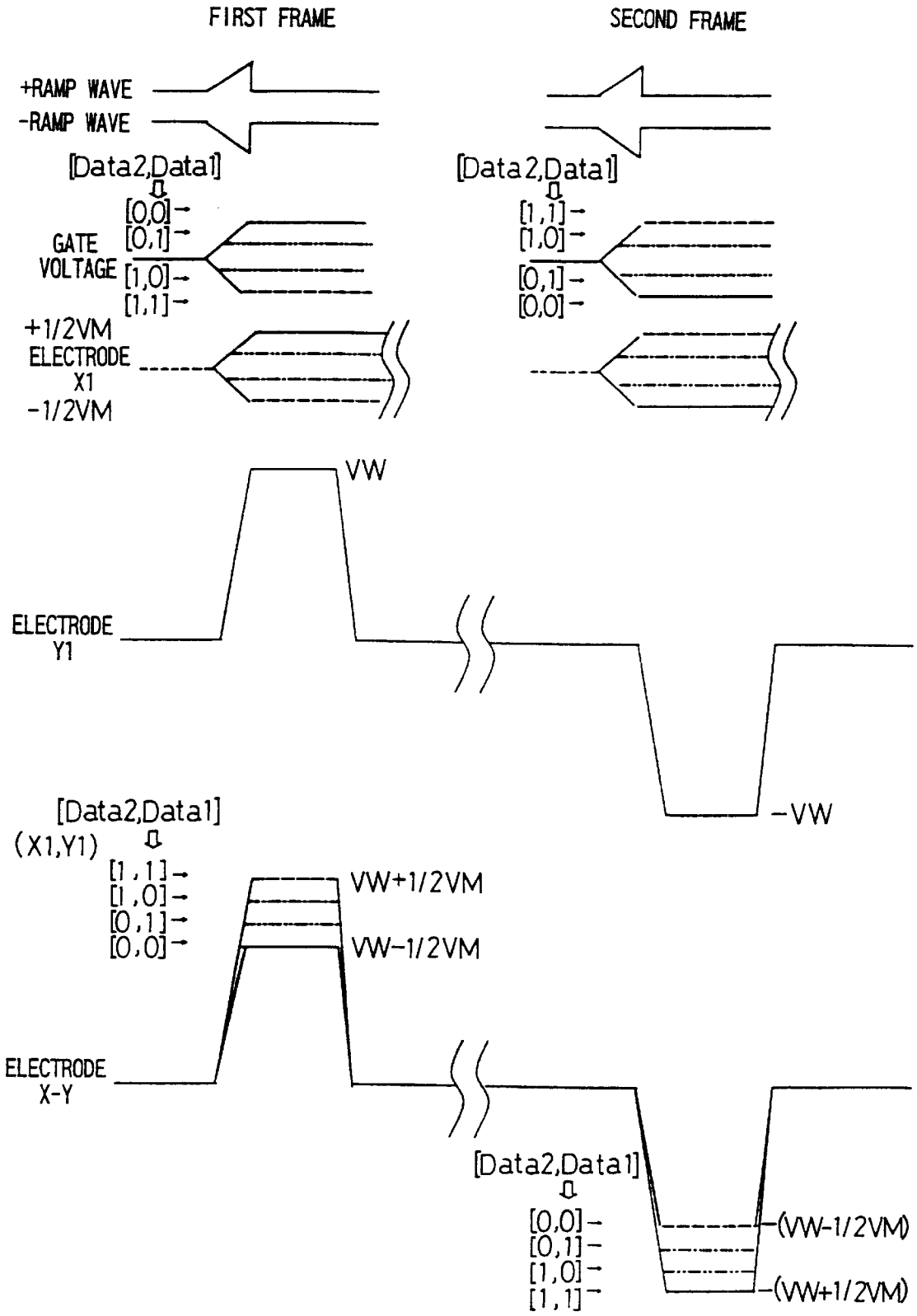
FIG. 6 is a time chart showing exemplary driving waveforms used to drive the EL display apparatus 50 by means of the driving circuit 89 of the EL display apparatus shown in FIG. 5.

FIG. 6 shows pulse waveforms when voltage is applied to the EL device located on the point of intersection (X1,Y1) using the driving circuit 89 of the EL display apparatus shown in FIG. 5, where the output voltage of the data side driving IC is varied in accordance with display data (Data 1 and Data 2) as in the case shown in FIG. 4. Since the voltage polarity is inverted when the frame is changed from the first frame to the second frame and vice versa, the relationship between a voltage outputted from the data side and the display data (Data 1 and Data 2) is also inverted, whereby a symmetric waveform can be applied to the EL panel when displaying a gray scale image.

Figure 18:
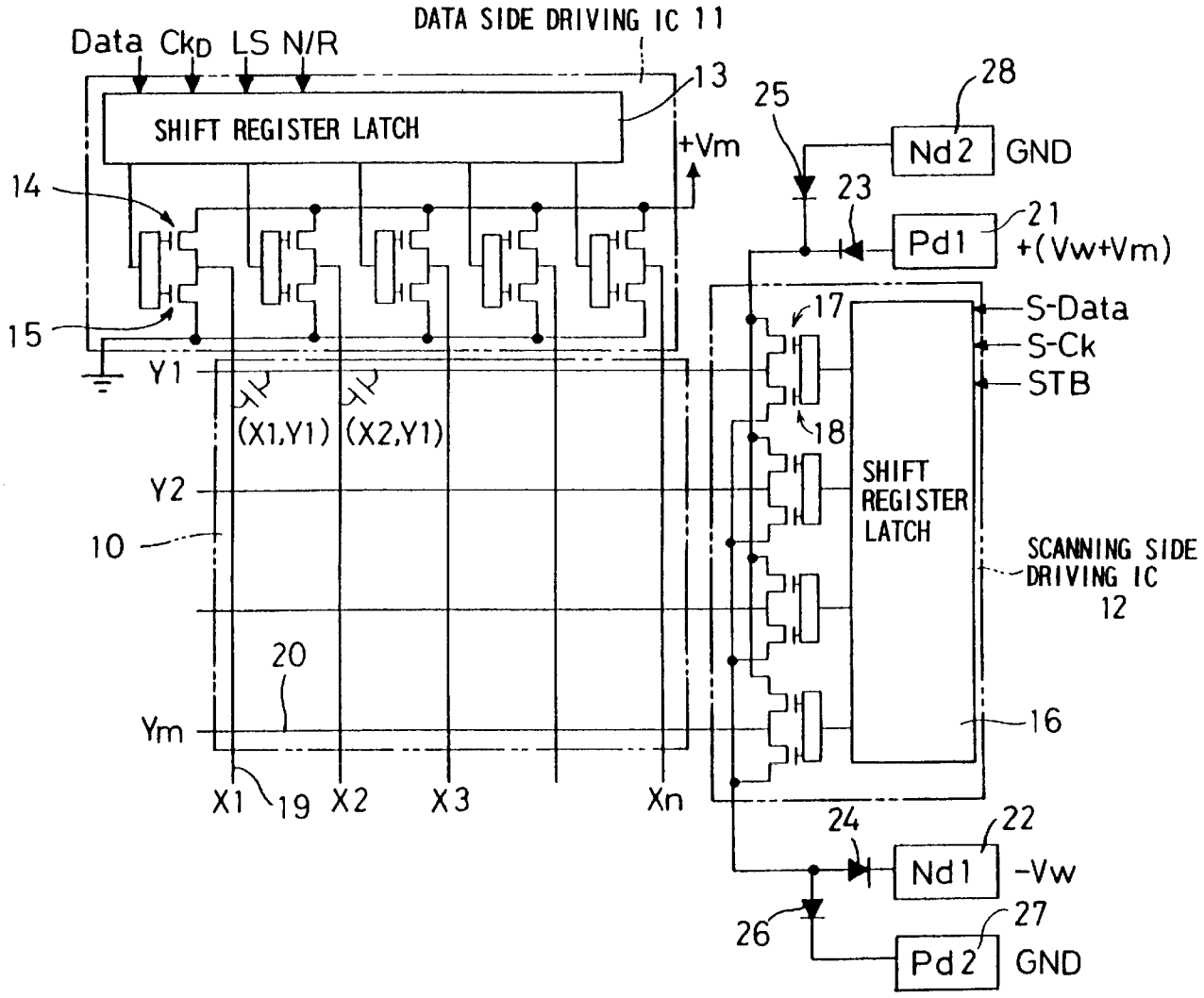
FIG.18 Prior Art
FIG. 18 is a block diagram schematically showing the electric circuit configuration of a driving circuit of a conventional EL display apparatus.

The conventional circuit shown in FIG. 18 needs to vary the amplitudes of respective positive and negative writing voltages to be applied to the EL panel. In contrast, the driving circuit of each of the foregoing embodiments of the invention shown in FIG. 1 or FIG. 5 does not need to change the amplitudes of respective positive and negative voltages and hence is capable of realizing a reliable long-term driving operation based on well-symmetrized waveforms by applying alternated voltages. Further, the amplitude of a positive voltage to be applied to each scanning electrode 60 is lower by ½VM in absolute value than that of a conventionally-used driving voltage and, hence, the withstand voltage of components of a power supply circuit can be lowered. Accordingly, the structure of peripheral circuits can also be simplified compared to the case of conventionally used driving circuits, thus making it possible a cost reduction.

Figure 7:
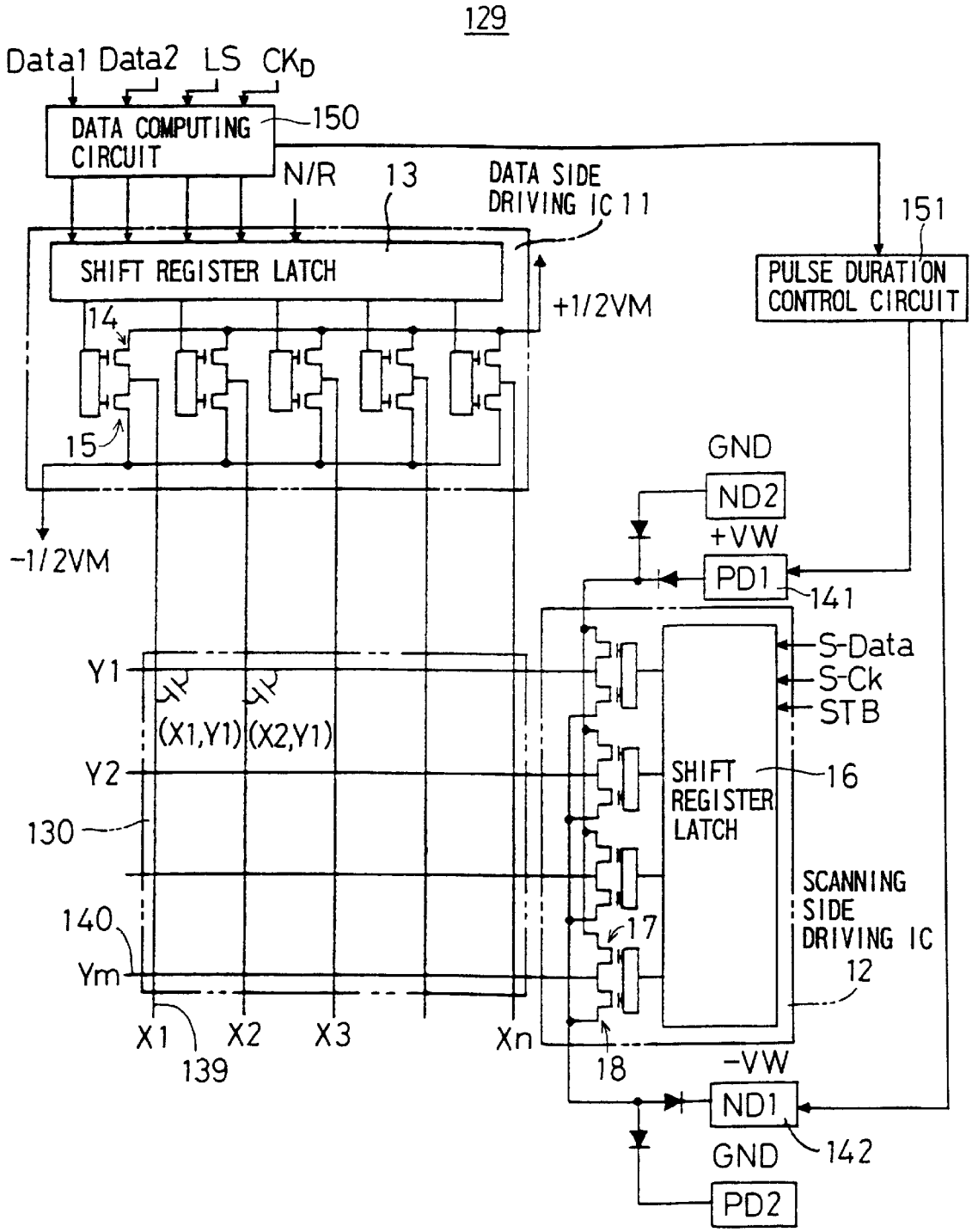
FIG. 7 is a block diagram schematically showing the electric circuit configuration of a driving circuit 129 as another embodiment of the invention.

FIG. 7 is a schematic illustration of the electric circuit of a driving circuit 129 as one embodiment of the invention. The driving circuit 129 includes parts of same names as those of the driving circuit in FIG. 18: data side driving IC 11, scanning side driving IC 12, shift register latch 13, pull-up elements 14, pull-down elements 15, shift register latch 16, pull-up elements 17 and pull-down elements 18. EL display panel 130 has n data electrodes 139 (X1 to Xn) as first group electrodes and m scanning electrodes 140 (Y1 to Ym) as second group electrodes. The driving circuit 129 also includes a positive voltage supply circuit 141 and a negative voltage supply circuit 142. The data side driving IC 11 is of the doublewell structure and is capable of switching the polarity of a modulating voltage to be applied to each data electrode 139 to positive or negative in accordance with display data. This embodiment further includes data computing circuit 150 and pulse width control circuit 151 for correcting a gray scale display. Display data is represented on a 2-bit basis as Data 1 and Data 2, and a gray scale display with four levels of luminance is realized. The relationship between inputted signals Data 1 and Data 2 and the gray scale levels is shown in the following Table 1.

TABLE 1

| Gray Scale Level | Data 1 | Data 2 | Luminance |
|---|---|---|---|
| L3 | 1 | 1 | Bright |
| L2 | 0 | 1 | ↓ |
| L1 | 1 | 0 | Dark |
| L0 | 0 | 0 | Off Luminescence |

Voltages of VM and VW are defined as follows. VM is a voltage for controlling the occurrence of luminescence of each EL device and can be established as any desired value within a range from several volts to dozens of volts so long as it is lower than the luminescence initiating voltage. VW is established as any desired value within a range of dozens of volts plus or minus the sum of the luminescence initiating voltage and ½VM as a reference voltage.

Figure 8:
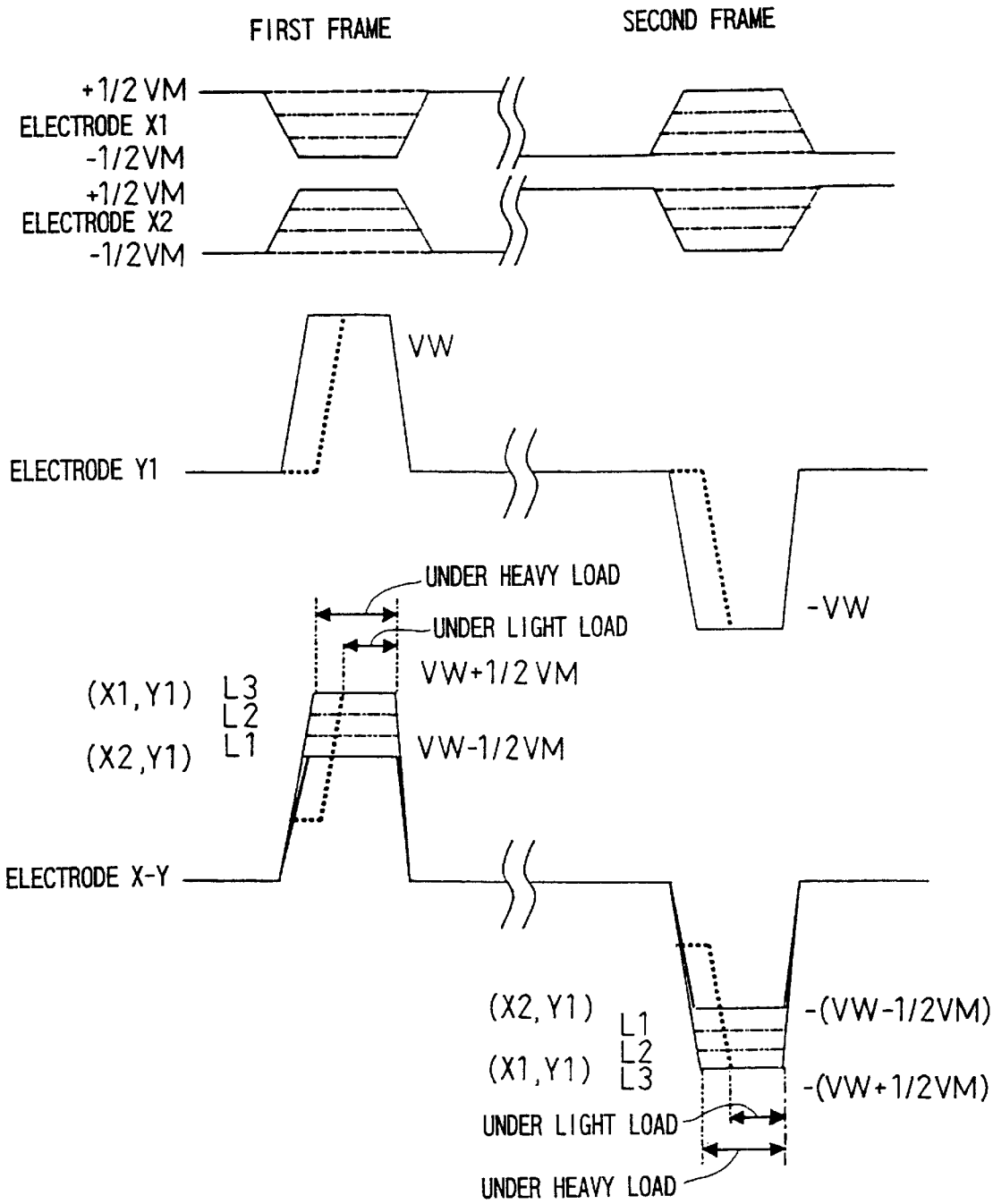
FIG. 8 is a time chart showing driving waveforms used to drive an EL display panel 130 by means of the driving circuit 129 shown in FIG. 7.

FIG. 8 shows pulse waveforms when voltage is applied to the EL display panel 130 using the driving circuit 129 according to the subject embodiment. In the first frame, first, display data (Data) and clock (CkD) are sequentially inputted into the data side driving IC 11 and then transferred to the location of a specified data electrode with use of the shift register latch 13, followed by temporary latching of the display data using a latch strobe (LS) by the shift register latch 13. The display data, clock and latch strobe are inputted into the data side driving IC 11 through the data computing circuit 150.

With the scanning electrodes 140 (Y1 to Ym) connected to the scanning side driving IC 12 being kept at a floating potential, pull-down elements 15 connected to data electrodes 139 including X1 on which EL devices to be illuminated are available are turned ON according to the data latched so that the respective data electrodes 139 are applied with a voltage of −½VM, −½VM+V1 or −½VM+V 2 according to gray scale level L3, L2 or L1, respectively. Pull-up elements 14 connected to data electrodes including X2 on which EL devices not to be illuminated are available are turned ON to charge the respective data electrodes up to a potential of +½VM. V1 and V2 satisfy the following relation: V1<V2 and −½VM<−½VM+V1<−½VM+V2<+½VM.

Then, the driving IC connected to Y1 selected among the scanning electrodes 140 outputs a voltage of +VW supplied from the positive voltage supply circuit 141 to the scanning electrode Y1 through the pull-up element 17 to raise the potential of Y1 up to +VW. As a result, the EL device at the intersection (X1,Y1) of the data electrode X1 and the scanning electrode Y1 is applied with a voltage sufficient to cause luminescence and hence emits light. On the other hand, the EL device at the intersection (X2,Y1) of the data electrode X2 and the scanning electrode Y1 is applied with a voltage of +(VW−½VM) which is not as much as causing luminescence and hence does not emit light.

The voltage sufficient to cause luminescence is +(VW+½VM) for gray scale level L3, +(VW+½VM−V1) for gray scale level L2, or +(VW+½VM−V2) for gray scale level L1. Further, the scanning electrode Y1 is discharged to the GND potential through a terminal of PD2 thereby ending the driving operation with respect to the selected scanning electrode Y1. A similar driving operation is repeated for scanning electrodes Y2 through Ym, sequentially line by line, to complete the driving operation with respect to the first frame.

In the second frame, as in the case of first frame, display data (Data) and clock ($Ck_D$) are sequentially inputted into the data side driving IC 11 and then transferred to the location of a specified data electrode with use of the shift register latch 13, followed by temporary latching of the display data using a latch strobe (LS). With the scanning electrodes 140 (Y1 to Ym) connected to the scanning side driving IC 12 being kept at a floating potential, pull-down elements 15 connected to the data electrodes 139 including X1 on which EL devices to be illuminated are available are turned ON according to the display data latched by the shift register latch 13 to charge the data electrodes 139 up to +½VM, +½VM−V1 or +½VM−V2 according to gray scale level L3, L2 or L1, respectively. Pull-up elements 14 connected to the data electrodes including X2 on which EL devices not to be illuminated are available are turned ON so that the data electrodes are given a potential of −½VM. V1 and V2 are voltages equal to those used in the first frame and satisfy the following relation: V1<V2 and +½VM>+½VM−V1>+½VM−V2 >−½VM.

Then, the driving IC connected to Y1 selected among the scanning electrodes 140 outputs a voltage of −VW supplied from terminal ND1 of the negative voltage supply circuit 142 to the scanning electrode Y1 through the respective pull-down element 18 to raise the potential of Y1 up to −VW. As a result, the EL device at the intersection (X1,Y1) of the data electrode X1 and the scanning electrode Y1 is applied with a voltage sufficient to cause luminescence and hence emits light. On the other hand, the EL device at the intersection (X2,Y1) of the data electrode X2 and the scanning electrode Y1 is applied with a voltage of −(VW−½VM), which is not as much as causing luminescence, and hence does not emit light. In this case the voltage sufficient to cause luminescence is −(VW+½VM) for gray scale level L3, −(VW+½VM−V1) for gray scale level L2, or −(VW+½VM−V2) for gray scale level L1. Further, the scanning electrode Y1 is discharged to the GND potential through a terminal of ND2. Thus, the driving operation with respect to the selected scanning electrode Y1 ends. A similar driving operation is repeated for scanning electrodes Y2 to Ym, sequentially line by line, to complete the driving operation with respect to the second frame. Repeating the above driving operations line by line, alternately performing the first and second frame sequences, makes it possible to apply alternating pulses of having positive or negative polarity to the EL display panel 10, and thereby displaying a desired image.

The method of correction using the driving circuit 129 shown in FIG. 7 according to the invention is as follows. Among the signals to be inputted to the data side driving IC 11, data signals (Data 1 and Data 2), latch strobe signal (LS)

and data transfer clock ($Ck_D$) are first inputted to the data computing circuit 150 where signal inputs of Data 1 and Data 2 are added together. The result of addition is outputted using the latch strobe signal (LS) and then the data computing circuit 150 is initialized, and a result of addition for one line is obtained. Then, first several bits of the result of addition are fetched to invert, and then the inverted data is counted with the data transfer clock ($Ck_D$) or a clock resulting from division of the data transfer clock ($Ck_D$). A pulse width control signal is generated so as the output to be "High" when the clock counts the number represented by the outcome of inverted bits. The pulse width control signal and the clock are transmitted to the pulse width control circuit 151 where the pulse width control signal is synchronized with the rising time of a write voltage. The pulse width control circuit 151 causes the write voltage to start rising when the output of the pulse width control signal becomes "High" as illustrated by a dotted line in FIG. 8, thereby varying the pulse width of the write voltage.

Figure 9:
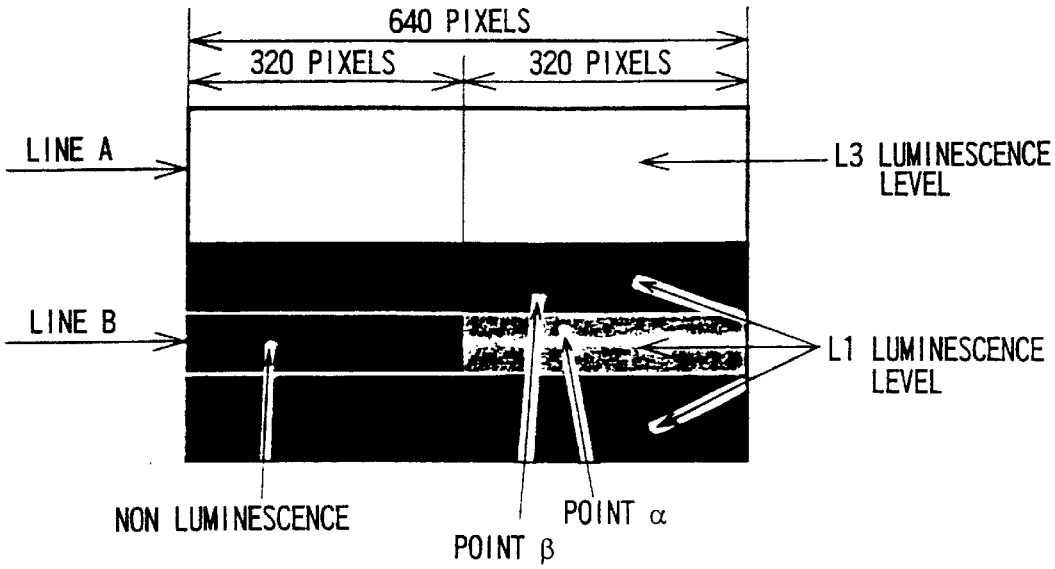
FIG. 9 illustrates an example of a display screen provided by the EL display panel 130 shown in FIG. 7.
Figure 10:
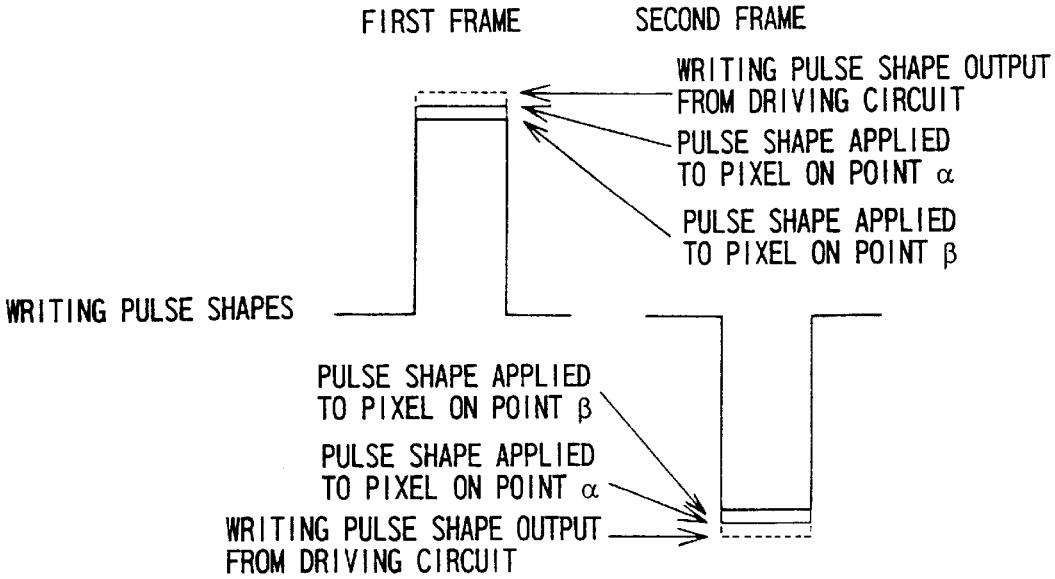
FIG. 10 is a voltage waveform chart illustrating a variation in the amplitude of a voltage applied to each pixel with a variation in the number of pixels giving off light on one line.
Figure 11:
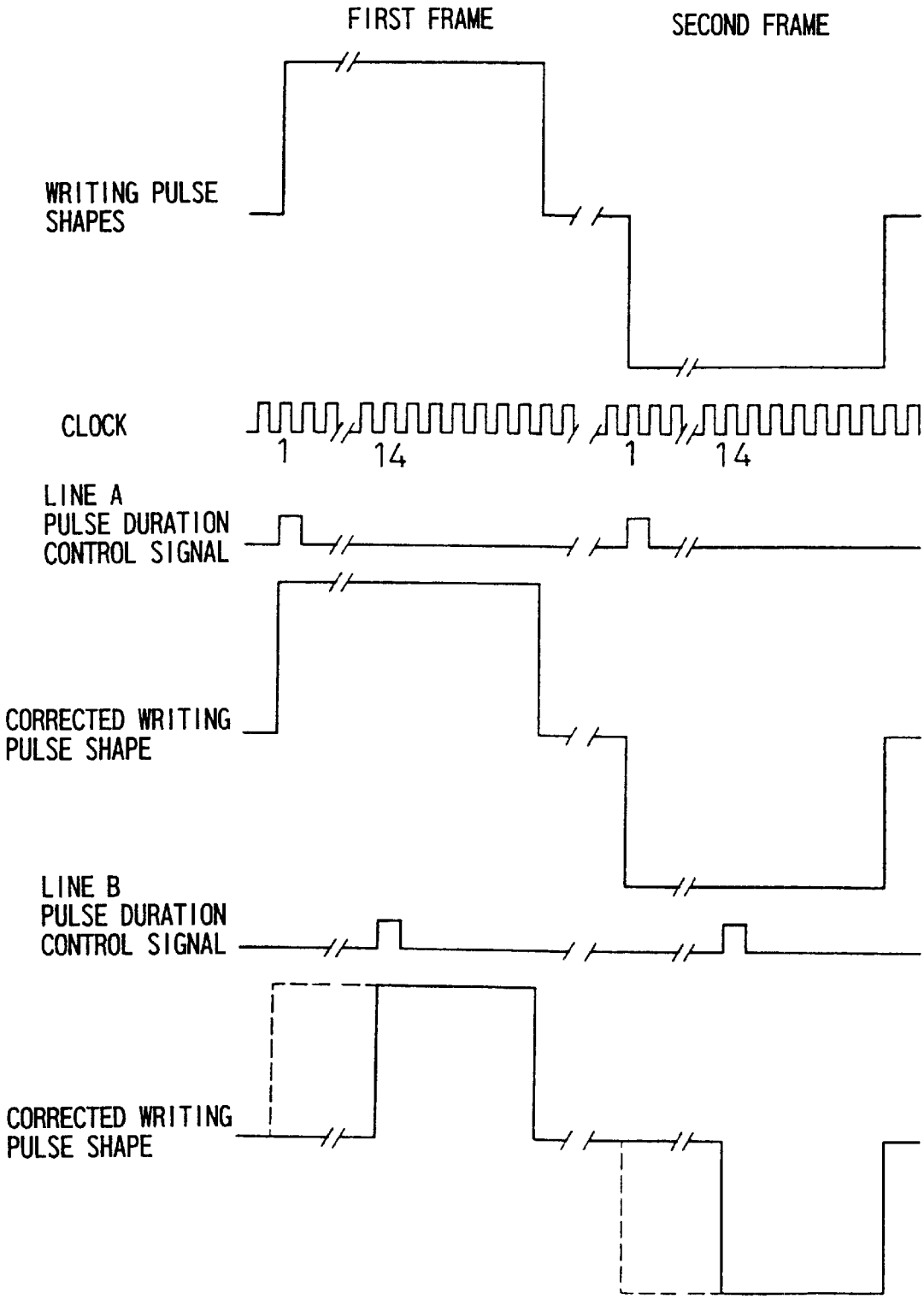
FIG. 11 is a voltage waveform chart illustrating an operation of correcting a write voltage waveform by means of a pulse width control signal in the embodiment shown in FIG. 7.

FIG. 9 illustrates an example of a display consisting of 640 pixels per line for example, in an EL display apparatus. When the lines are driven similarly to the above method, points $\alpha$ and $\beta$ on lines A and B respectively are applied with different voltage levels even showing the same gray scale level L1, as in FIG. 10. FIG. 11 illustrates a correction operation according to the embodiment. All the pixels on line A emit light at gray scale level L3 and the result of the line data addition is "11110000000". The first four bits are "1111". When "1111" is inverted, it becomes "0000" and, hence, a pulse width control signal which becomes "High" at the first count of clock is outputted. Since a write voltage starts being applied to each pixel in response to this pulse width control signal, any modulation operation to shorten the pulse width with respect to the write voltage is not performed.

In the case where 320 pixels on one line are off luminescence while other 320 pixels on the same line emitting light at gray scale level L1 as shown by line B in FIG. 9, the result of the line data addition is "00101000000". The first four bits show "0010", and the inversion is "1101". Hence, a pulse width control signal which becomes "High" at the 14th count of clock is outputted. This pulse width control signal causes starting of application of a write voltage to be delayed by 13 counts of clock thereby causing the write voltage having a shortened pulse width to be applied. In this way, an uniformed display can be obtained.

Although the method of correction with respect to the above explained embodiment is performed using the first four bits of the result of the line data addition, more bits may be fetched or a different number of frequency division for counting operation about the data transfer clock may be used in order to achieve a more precise correction performance. Further, though the subject embodiment performs a correction by adding digital signals at the data computing circuit 150, a similar control signal can also be obtained by subtraction.

Although the subject embodiment performs a correction based on the results of addition of all gray scale data for one line, gray scale data corresponding to only first several bits for the line may be used when the total volume of gray scale data is large. It is also possible to use any other clock than the data transfer clock ($Ck_D$). The invention can easily be applied to any screen configuration other than the configuration having 640 pixels per line or to any display other than the four-level gray scale display by performing a correction, insofar as desired bits obtained from the result of line data addition with respect to a maximum gray scale level can all take "1".

Although the gray scale data signals are inputted as digital data in the foregoing example, a similar correction is also possible by using analog data input so long as it can be converted to digital data by A/D conversion. Alternatively, a method of adding analog signals using a capacitive element or a like element enables computing of analog data as it is without performing A/D conversion thereby realizing a similar correction. Unless the long-term reliability is influenced, it is possible that the pulse width of a write voltage is modulated in only one of the first and second frames. It is also possible to perform a modulation by using the falling edge of a voltage waveform instead of the rising edge thereof or both the rising edge and the falling edge of the pulse waveform.

Figure 12:
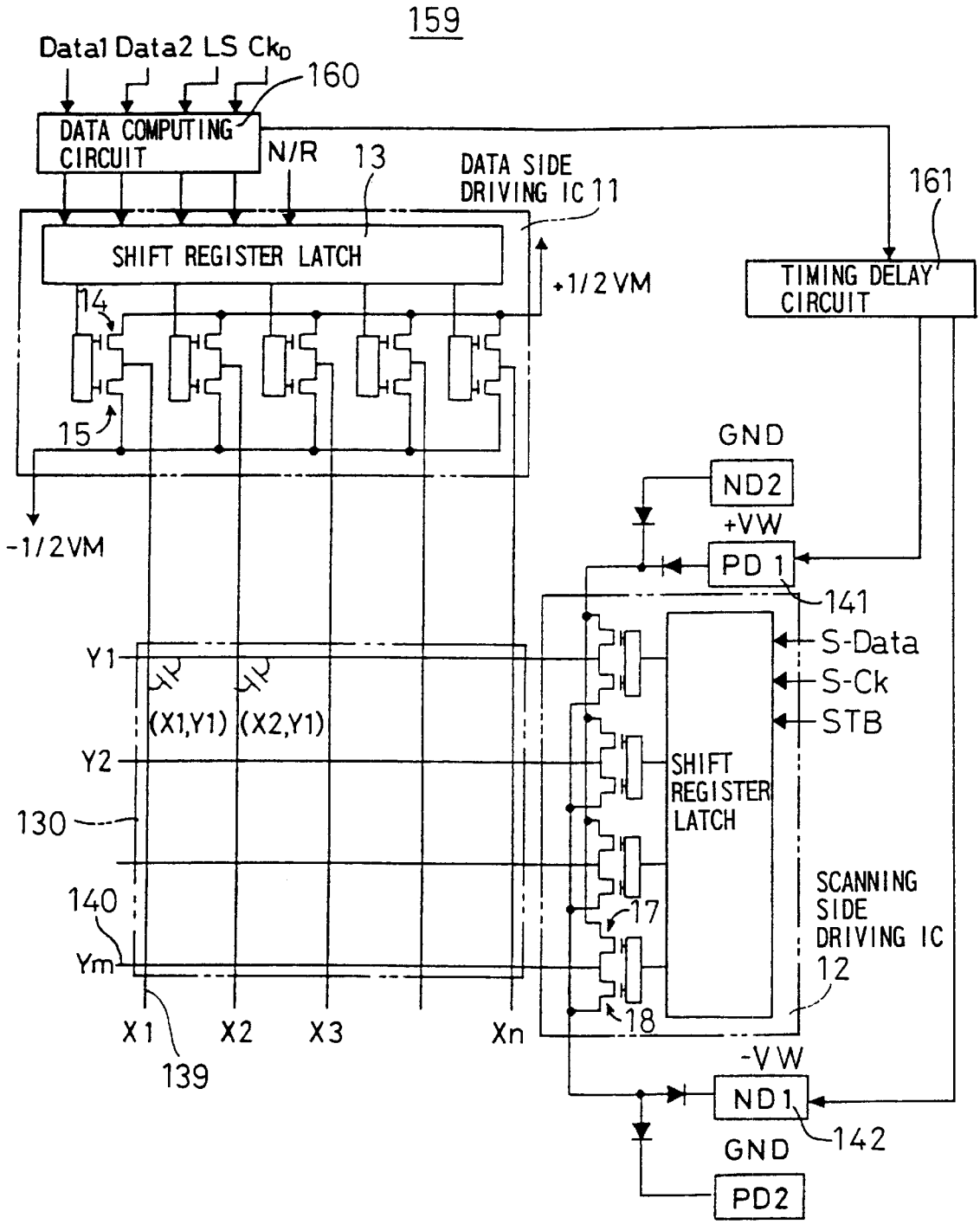
FIG. 12 is a block diagram schematically showing the electric circuit configuration of a driving circuit 159 as another embodiment of the invention.
Figure 13:
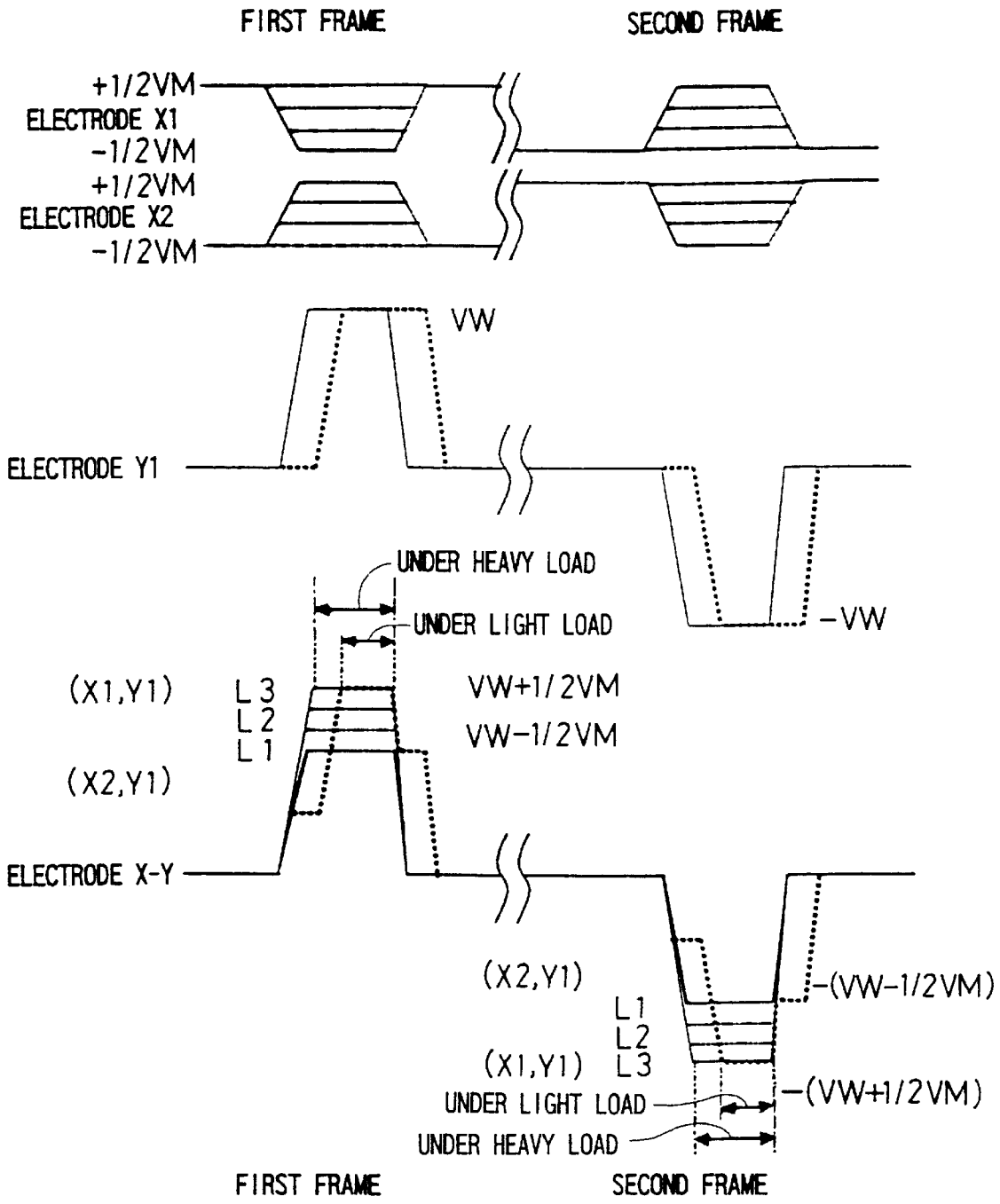
FIG. 13 is a time chart showing driving waveforms used to drive the EL display panel 130 by means of the driving circuit 159 shown in FIG. 12.
Figure 14:
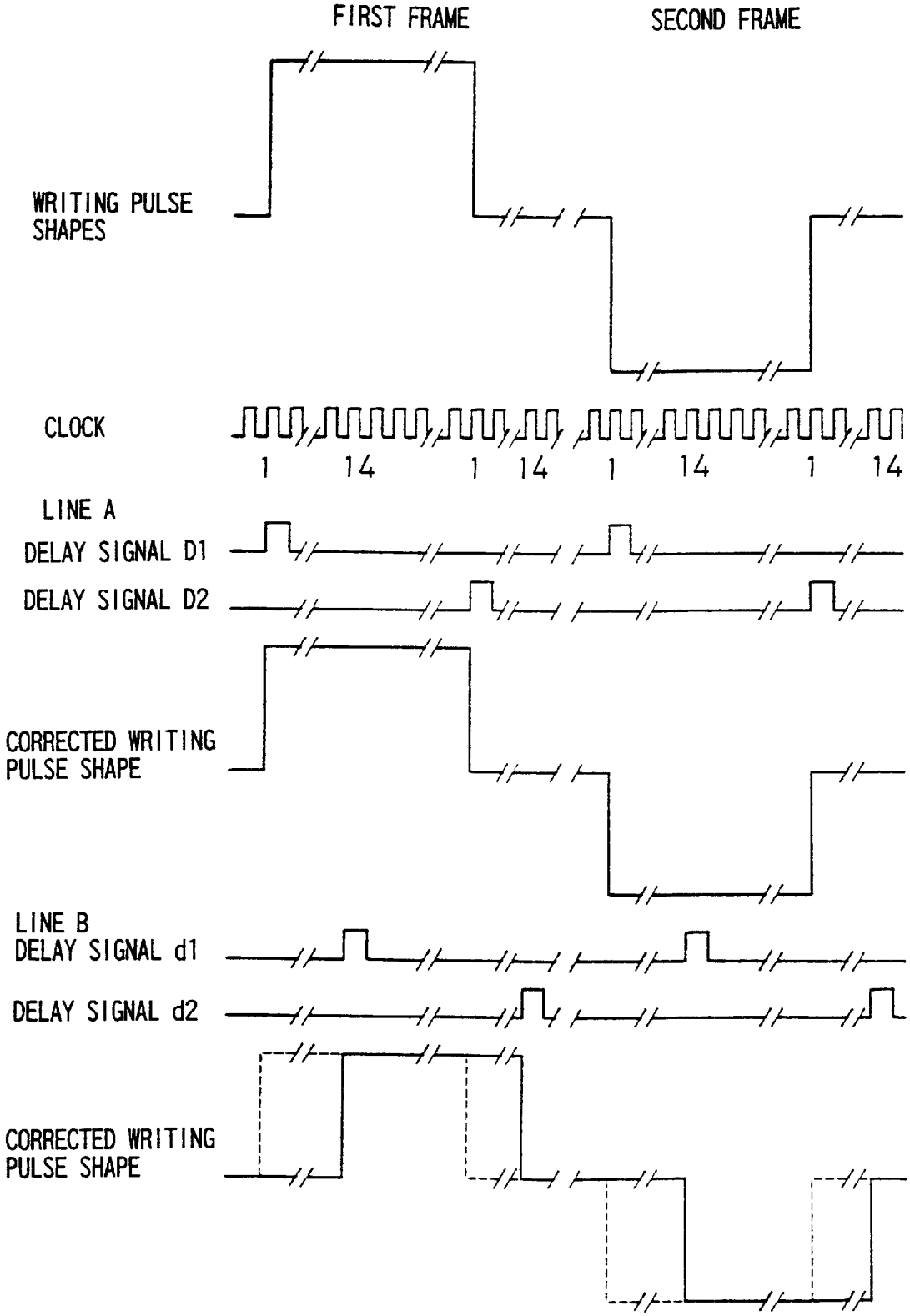
FIG. 14 is a time chart illustrating an operation of correcting a write voltage waveform based on a delay signal performed by the driving circuit 159 shown in FIG. 12.

FIG. 12 is a schematic illustration of the electric circuit with respect to a driving circuit 159 as another embodiment of the invention. FIG. 13 shows pulse waveforms when driving voltage is applied to EL display panel 130. FIG. 14 illustrates a correction operation. Same reference characters are used to the parts corresponding to those of the embodiment represented by FIG. 7, where repetition of same descriptions is avoided. In the driving circuit 159 according to this embodiment, a timing delay circuit 161 adjusts the timing with which write voltages are applied on the basis of the results of operation at data computing circuit 160, thereby achieving a correction without changing the pulse length. First, the data computing circuit 160 adds display data signals Data 1 and Data 2 together for one line, fetches first four bits of the result of addition, and transmits the data obtained thereof to the timing delay circuit 161. The timing delay circuit 161 in turn delays a write control signal to vary the time period for which a modulating voltage and a write voltage are applied simultaneously.

Among the signals to be inputted into the data side driving IC 11, data signals (Data 1 and Data 2), latch strobe signal (LS) and data transfer clock ($Ck_D$) are first inputted into the data computing circuit 160 where signal inputs of Data 1 and Data 2 are added together. The result of addition is outputted using the latch strobe signal (LS) and then the data computing circuit 160 is initialized, and a result of addition for one line is obtained. As such, utilizing the timing of the latch strobe signal, a result of the line data addition can be obtained. First several bits of the result of addition are fetched to invert, and then the inverted data is counted with the data transfer clock ($Ck_D$) or a clock resulting from division of the data transfer clock($Ck_D$) Pulse width control signals D1 and D2 are generated so as the outputs to be "High" when the clock counts the number represented by the outcome of inverted bits. The delay signals D1 and D2 and the clock are transmitted to the timing delay circuit 161 where the rising edge and the falling edge of a write voltage are modulated.

In the case of the EL display apparatus having 640 pixels per line shown in FIG. 9, when all the pixels on line A emit light at gray scale level L3, the result of addition is "11110000000", where the first four bits show "1111". When "1111" is inverted, it becomes "0000" and, hence, delay signals D1 and D2 are outputs which become "High" at the first count of clock. Since a write voltage starts charging or discharging with respect to each pixel in response to the delay signal D1 or D2, any delay of the write voltage does not occur. In the case where 320 pixels on one line are off luminescence while the other 320 pixels on the same line emitting light at gray scale level L1 as on line B in FIG. 9, the result of addition is "00101000000". The first four bits show "0010", and the inversion is "1101". Hence, delay signals d1 and d2 which becomes "High" at the 14th count of clock as shown in FIG. 14 are outputted. The delay signals D1 and D2 cause charging and discharging of a write voltage to be delayed by 13 counts of clock thereby delaying the whole write voltage as illustrated by dotted line in FIG. 13. Though the rising and falling of the write voltage can be delayed in the same way, however, the falling edge of the write pulse does not overlap the falling edge of the modulating voltage. Thus, the delay on the rising edge of the write pulse results in a shortening effect to a pulse length as shown in FIG. 8. In this way, an uniformed display can be obtained.

Although a correction is performed using the first four bits fetched from the result of addition of data in this embodiment, a more precise correction can be achieved by increasing the number of bits or using a different number of frequency division for counting operation about the data transfer clock. Further, though the subject embodiment performs a correction based on the result obtained by addition of digital signals at the data computing circuit 160, a similar control signal can also be obtained by subtraction. Although the subject embodiment performs a correction based on the result of addition of all gray scale data for one line, a similar correction can be achieved only with gray scale data corresponding to first several bits of the line when the volume of gray scale data is large.

Further, it is possible to use any other clock than the data transfer clock ($Ck_D$). The invention can easily be applied to any screen configuration other than the configuration having 640 pixels per line or to any display other than the four-level gray scale display, so as not to perform a correction based on the result of addition of a maximum gray scale level with respect to one line data, but on the basis of correction where any desired bit among the result of addition be "1". In this embodiment, too, a similar correction as the former embodiment is possible by performing A/D conversion of analog data input as gray scale data signals, or alternatively, by employing an analog computing method using a capacitive element or a like element without performing A/D conversion. Unless the long-term reliability is influenced, it is possible that the write voltage application timing is adjusted in only one of the first and second frames. The same effect can also be obtained by adjusting the modulating voltage application timing instead of the write voltage application timing or by adjusting a relative timing between the two.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electroluminescent display apparatus comprising:

a first group of data electrodes;

a second group of scanning electrodes, the data electrodes and scanning electrodes being arranged to extend in respective different directions crossing each other as viewed from above;

an electroluminescent layer sandwiched between the data electrodes and the scanning electrodes;

a first driving circuit, in communication with the data electrodes, for applying modulating voltages of both positive and negative polarity to the data electrodes; and a second driving circuit, in communication with the scanning electrodes, for applying write voltages of positive and negative polarity having an equal absolute value, to the scanning electrodes, and/or capable of switching a potential of the scanning electrodes to either a ground potential or a floating potential.

2. The electroluminescent display apparatus of claim 1, wherein the first driving circuit is capable of varying the modulating voltage according to a signal inputted thereto and outputting the modulating voltage thus varied.

3. The apparatus of claim 1, wherein the positive and negative modulating voltages applied to the data electrodes are each of a value of about ½ of a difference between (a) a voltage that initiates luminance of the electroluminescent layer, and (b) a luminescence voltage at which the electroluminescent layer is in a luminance saturation zone.

4. The apparatus of claim 1, wherein the absolute value of the write voltage is selected to be larger than that of a voltage that initiates luminescence of the electroluminescent layer and lower than a luminescence voltage at which the electroluminescent layer is in a luminance saturation zone.

5. An electroluminescent display apparatus comprising:

a first group of electrodes;

a second group of electrodes, the first group of electrodes and second group of electrodes being arranged to extend in respective directions crossing each other as viewed from above;

an electroluminescent layer sandwiched between the first group of electrodes and the second group of electrodes;

a first driving circuit, in communication with the first group of electrodes, for applying a modulating voltage of positive or negative polarity to the first group of electrodes through output terminals thereof;

a second driving circuit, in communication with the second group of electrodes, for applying write voltages of positive or negative polarity, having an equal absolute value, to the second group of electrodes through output terminals thereof, or capable of switching a potential of the second group of electrodes to either a ground potential or a floating potential;

wherein the absolute value of the write voltage is selected to be larger than that of a voltage that initiates luminescence of the electroluminescent layer and lower than a luminescence voltage at which the electroluminescent layer is in a luminance saturation zone; and the modulating voltage is of such a magnitude that a sum of the modulating voltage and the write voltage increases up to the luminescence voltage within the luminance saturation zone while a difference obtained by subtracting the modulating voltage from the write voltage decreases from the luminescence initiating voltage to a voltage within a predetermined range.

6. The electroluminescent display apparatus of claim 5, wherein the write voltage is selected to be a mid-voltage between the luminescence initiating voltage and the luminescence voltage, and the modulating voltage is selected so that a maximum value thereof is ½ as large as the difference between the luminescence initiating voltage and the luminescence voltage.

7. The electroluminescent display apparatus of claim 6, wherein the first driving circuit is capable of varying the modulating voltage according to a signal inputted thereto and outputting the modulating voltage thus varied.

8. The electroluminescent display apparatus of claim 5, wherein the first driving circuit is capable of varying the modulating voltage according to a signal inputted thereto and outputting the modulating voltage thus varied.

9. An electroluminescent display apparatus comprising:

a first group of electrodes;

a second group of electrodes, the first group of electrodes and second group of electrodes being arranged to extend in respective directions intersecting each other;

an electroluminescent layer sandwiched between the first group of electrodes and the second group of electrodes, points of intersection of the first group of electrodes and the second group of electrodes being driven with pulse waveforms to serve as pixels and display a gray scale image;

a first driving circuit having output terminals connected to respective ones of the first group of electrodes and capable of applying a modulating voltage of positive or negative polarity to each of the first group of electrodes;

a second driving circuit having output terminals connected to respective ones of the second group of electrodes and capable of switching each of the second group of electrodes between a state applied with a write voltage of positive or negative polarity and a state applied with a ground potential or a floating potential; and a correction circuit for computing display data indicative of a gray scale level for each of the pixels formed on the second group of electrodes line by line in the direction in which the second group of electrodes are arranged and varying a pulse width of a voltage waveform to be applied to each of the pixels on each line in accordance with the display data computed.

10. The electroluminescent display apparatus of claim 9, wherein the correction circuit is configured to vary the pulse width of the voltage waveform of at least one of the modulating voltage to be applied from the first driving circuit and the write voltage to be applied from the second driving circuit.

11. The electroluminescent display apparatus of claim 10, wherein the correction circuit is configured to vary relative timing between the modulating voltage to be applied from the first driving circuit and the write voltage to be applied from the second driving circuit.

12. The electroluminescent display apparatus of claim 10, wherein the correction circuit is configured to compute all or part of the gray scale data and vary the pulse width of a voltage waveform to be applied to each pixel according to all or part of the gray scale data computed.

13. The electroluminescent display apparatus of claim 10, wherein the correction circuit is configured to vary the pulse width of a voltage waveform to be applied to each of the pixels on each line equally with respect to positive polarity and negative polarity.

14. The electroluminescent display apparatus of claim 9, wherein the correction circuit is configured to vary relative timing between the modulating voltage to be applied from the first driving circuit and the write voltage to be applied from the second driving circuit.

15. The electroluminescent display apparatus of claim 14, wherein the correction circuit is configured to vary the pulse width of a voltage waveform to be applied to each of the pixels on each line equally with respect to positive polarity and negative polarity.

16. The electroluminescent display apparatus of claim 14, wherein the correction circuit is configured to compute all or part of the gray scale data and vary the pulse width of a voltage waveform to be applied to each pixel according to all or part of the gray scale data computed.

17. The electroluminescent display apparatus of claim 9, wherein the correction circuit is configured to vary the pulse width of a voltage waveform to be applied to each of the pixels on each line equally with respect to positive polarity and negative polarity.

18. The electroluminescent display apparatus of claim 17, wherein the correction circuit is configured to compute all or part of the gray scale data and vary the pulse width of a voltage waveform to be applied to each pixel according to all or part of the gray scale data computed.

19. The electroluminescent display apparatus of claim 9, wherein the correction circuit is configured to compute all or part of the gray scale data and vary the pulse width of a voltage waveform to be applied to each pixel according to all or part of the gray scale data computed.

* * * * *